US006195988B1

(12) United States Patent
Yasui et al.

(10) Patent No.: US 6,195,988 B1
(45) Date of Patent: Mar. 6, 2001

(54) AIR-FUEL RATIO CONTROL SYSTEM FOR INTERNAL COMBUSTION ENGINE

(75) Inventors: Yuji Yasui; Shusuke Akazaki; Tadashi Sato; Masaki Ueno; Yoshihisa Iwaki, all of Wako (JP)

(73) Assignee: Honda Giken Kogyo Kabushiki Kaisha, Tokyo (JP)

( * ) Notice: Under 35 U.S.C. 154(b), the term of this patent shall be extended for 0 days.

(21) Appl. No.: 09/499,975

(22) Filed: Feb. 8, 2000

(30) Foreign Application Priority Data

Feb. 9, 1999 (JP) ..... 11-031144

(51) Int. Cl.[7] ..... F01N 3/00

(52) U.S. Cl. ..... 60/285; 60/276; 60/277; 123/674; 701/29; 701/103; 701/109

(58) Field of Search ..... 60/274, 285, 276, 60/277, 301, 297; 123/674, 679, 972; 701/103, 109, 115, 29

(56) References Cited

U.S. PATENT DOCUMENTS 5,694,910 12/1997 Hasegawa et al. .
5,845,490 12/1998 Yasui et al. .
5,845,491 12/1998 Yasui et al. .
5,852,930 12/1998 Yasui et al. .
5,880,952 3/1999 Yasui et al. .
5,924,281 7/1999 Yasui et al. .
6,112,517 * 9/2000 Yasui et al. ..... 60/274

FOREIGN PATENT DOCUMENTS 5-79374 3/1993 (JP) .
8-21273 1/1996 (JP) .
11-93741 4/1999 (JP) .

* cited by examiner

*Primary Examiner*—Thomas Denion
*Assistant Examiner*—Binh Tran
(74) *Attorney, Agent, or Firm*—Arent Fox Kintner Plotkin & Kahn PLLC

(57) ABSTRACT

An object system for generating an output signal of an $O_2$ sensor from a target air-fuel ratio is expressed as a model including a response delay element and a dead time element. Data of identified values of parameters of the model are sequentially generated by an identifier. Data of an estimated value of the output signal of the $O_2$ sensor after a dead time of the object system is sequentially generated by an estimator. The target air-fuel ratio is generated according to an adaptive sliding mode control process performed by a sliding mode controller using the data of the identified and estimated values. The air-fuel ratio of an internal combustion engine is manipulated on the basis of the target air-fuel ratio according to a feed-forward control process.

29 Claims, 12 Drawing Sheets

AIR-FUEL RATIO CONTROL SYSTEM FOR INTERNAL COMBUSTION ENGINE

BACKGROUND OF THE INVENTION

1. Field of the Invention

The present invention relates to an air-fuel ratio control system for an internal combustion engine.

2. Description of the Prior Art

The applicant of the present application has proposed an air-fuel ratio control system having an exhaust gas sensor for detecting the concentration of a certain component of an exhaust gas that has passed through a catalytic converter such as a three-way catalytic converter disposed in the exhaust passage of an internal combustion engine, such as an $O_2$ sensor for detecting the concentration of oxygen in the exhaust gas, the exhaust gas sensor being disposed downstream of the catalytic converter. The system controls the air-fuel ratio of the internal combustion engine, more accurately, the air-fuel ratio of an air-fuel mixture to be combusted by the internal combustion engine, in order to converge an output of the $O_2$ sensor, i.e., the detected value of the oxygen concentration, to a predetermined target value for enabling the catalytic converter to have a desired purifying ability irrespective of the aging of the catalytic converter. See U.S. patent application Ser. No. 09/153300, for example.

According to the disclosed technology, a manipulated variable for manipulating the air-fuel ratio of the internal combustion engine, specifically, a target air-fuel ratio or a quantity defining such a target air-fuel ratio, is successively generated in given control cycles in order to converge the output of the $O_2$ sensor to its target value based on a feedback control process. An exhaust gas sensor (hereinafter referred to as an "air-fuel ratio sensor) for detecting the air-fuel ratio of the exhaust gas that enters the catalytic converter, specifically, the air-fuel ratio of the air-fuel mixture that has been burned by the internal combustion engine, is disposed upstream of the catalytic converter. The amount of fuel supplied to the internal combustion engine is regulated so as to converge the output of the air-fuel ratio sensor, i.e., the detected value of the air-fuel ratio, to a target air-fuel ratio defined by the manipulated variable for thereby controlling the air-fuel ratio of the internal combustion engine at the target air-fuel ratio.

Such air-fuel ratio control for the internal combustion engine is capable of converging the output of the $O_2$ sensor disposed downstream of the catalytic converter to its target value for thereby enabling the catalytic converter to have a desired purifying ability.

In the above air-fuel ratio control system, the $O_2$ sensor is used as the exhaust gas sensor disposed downstream of the catalytic converter. However, the exhaust gas sensor may comprise an NOx sensor, a CO sensor, an HC sensor, or another exhaust gas sensor. It is possible to enable the catalytic converter to have a desired purifying ability by controlling the air-fuel ratio of the internal combustion engine so as to converge the output of such an exhaust gas sensor to a suitable target value.

In order to increase the stability and reliability of the control process for converging the output of the $O_2$ sensor to its target value, a sliding mode control process (more specifically, an adaptive sliding mode control process), which is one type of feedback control process that is highly stable against disturbances, is used to generate the manipulated variable for converging the output of the $O_2$ sensor to its target value.

The sliding mode control process requires that an object to be controlled be modeled. According to the above technology, it is assumed that the output of the air-fuel sensor is feedback-controlled at a target air-fuel ratio determined by a manipulated variable. Therefore, the object to be controlled by the sliding mode control process is regarded as an exhaust system extending from the air-fuel ratio sensor to the $O_2$ sensor and including the catalytic converter, and the exhaust system is modeled by a discrete-time system. In order to compensate for the effect of behavioral changes of the modeled exhaust system, there is provided an identifier for identifying, successively on a real-time basis, parameters of the model to be established, using data of the output from the air-fuel ratio sensor and data of the output from the $O_2$ sensor. According to the sliding mode control process, the manipulated variable is generated by an algorithm constructed on the basis of the model using the data of the output from the $O_2$ sensor and the parameters of the model identified by the identifier.

Because it is assumed according to the above technology that the output of the air-fuel sensor is feedback-controlled at a target air-fuel ratio determined by a manipulated variable, if the air-fuel ratio sensor fails to operate for some reason, then the air-fuel ratio of the internal combustion engine cannot be appropriately manipulated into the target air-fuel ratio. In such a case, the output from the $O_2$ sensor positioned downstream of the catalytic converter cannot be controlled at the target value, making it impossible for the catalytic converter to have a desired purifying ability.

One solution is to regulate the amount of fuel supplied to the internal combustion engine according to a feed-forward control process using a map or the like depending on the target air-fuel ratio determined by the manipulated variable which is generated according to the sliding mode control process. At this time, the data of the target air-fuel ratio determined by the manipulated variable may be used instead of the data of the output from the air-fuel ratio sensor for identifying the parameters of the model.

According to the above technology, however, since the model as a basis for generating the manipulated variable is the model of the exhaust system extending from the air-fuel ratio sensor to the $O_2$ sensor and including the catalytic converter, the model does not take into account behavioral characteristics of the internal combustion engine and their changes. Consequently, even if the manipulated variable for the air-fuel ratio is generated according to the sliding mode control process constructed on the basis of the model, it is difficult make the generated manipulated variable suitable for behavioral states of the internal combustion engine. Even when the air-fuel ratio of the internal combustion engine is manipulated based on the manipulated variable according to the feed-forward control process, it is difficult to manipulate the air-fuel ratio of the internal combustion engine into an appropriate air-fuel ratio required to converge the output of the $O_2$ sensor to its target value in various behavioral states of the internal combustion engine. As a result, the control process for converging the output of the $O_2$ sensor to its target value cannot appropriately be performed stably, and hence the catalytic converter fails to have a desired purifying ability.

Furthermore, the above technology is disadvantageous as to cost because the air-fuel sensor is needed in the control process for converging the output of the $O_2$ sensor to its target value.

SUMMARY OF THE INVENTION

It is therefore an object of the present invention to provide an air-fuel ratio control system of relatively simple arrangement for stably and appropriately manipulating the air-fuel ratio of an internal combustion engine to converge the output of an exhaust gas sensor such as an $O_2$ sensor or the like disposed downstream of a catalytic converter to a predetermined target value, without using another exhaust gas sensor such as an air-fuel ratio sensor or the like.

To achieve the above object, there is provided in accordance with the present invention an air-fuel ratio control system for an internal combustion engine, comprising an exhaust gas sensor for detecting the concentration of a component of an exhaust gas which has passed through a catalytic converter disposed in an exhaust passage of the internal combustion engine, the exhaust gas sensor being disposed downstream of the catalytic converter, manipulated variable generating means for sequentially generating a manipulated variable for manipulating the air-fuel ratio of an air-fuel mixture to be combusted by the internal combustion engine in order to converge an output of the exhaust gas sensor to a predetermined target value, air-fuel ratio manipulating means for manipulating the air-fuel ratio of the air-fuel mixture based on the manipulated variable generated by the manipulated variable generating means, the arrangement being such that a system for generating the output of the exhaust gas sensor from the manipulated variable via the manipulated variable generating means, the internal combustion engine, and the catalytic converter is regarded as an object system, and the object system including an element relative to a response delay of the object system is expressed as a model by a discrete-time system, and identifying means for sequentially identifying a parameter to be established of the model using data of the manipulated variable generated by the manipulated variable generating means and data of the output of the exhaust gas sensor, the manipulated variable generating means comprising means for generating the manipulated variable according to a feedback control process constructed based on the model using the parameter of the model identified by the identifying means and the data of the output of the exhaust gas sensor.

In the above air-fuel ratio control system for the internal combustion engine, the model represents the overall behavior of the object system including the catalytic converter, the exhaust gas sensor, the internal combustion engine, and the air-fuel ratio manipulating means. The parameter to be established of the model (more specifically, the parameter to be set to a certain value for defining the behavior of the model) is sequentially identified on a real-time basis by the identifying means, using data of the manipulated variable which corresponds to an input quantity given to the object system and data of the output of the exhaust gas sensor which corresponds to an output quantity generated by the object system. Therefore, the model using the parameter accurately expresses the actual behavior of the object system in various operating states thereof regardless of behavioral changes of the internal combustion engine, the catalytic converter, etc. of the object system.

Since the manipulated variable is generated according to the feedback control process constructed on the model, using the data of the manipulated variable generated by the manipulated variable generating means and the data of the output of the exhaust gas sensor, the manipulated variable accurately reflects the overall behavior of the object system including the internal combustion engine, the catalytic converter, etc. Stated otherwise, the manipulated variable matches the behavior of the object system including the internal combustion engine, the catalytic converter, etc. for converging the output of the exhaust gas sensor to the target value. As a result, when the air-fuel ratio of the air-fuel mixture to be combusted by the internal combustion engine is manipulated based on the manipulated variable, the output of the exhaust gas sensor can stably and accurately be converged to the target value even if the air-fuel ratio of the air-fuel mixture is manipulated according to a feed-forward control process. Because the model is expressed by a discrete-time system, the process of identifying the parameter and the feedback control process based on the model can be constructed according to a discrete-time algorithm suitable for computer processing.

Accordingly, the air-fuel ratio of the internal combustion engine can be manipulated to converge the output of the exhaust gas sensor downstream of the catalytic converter to the target value, stably and appropriately by a simple system arrangement without using another exhaust gas sensor such as an air-fuel ratio sensor or the like. As the output of the exhaust gas sensor can stably be controlled at the target value, the catalytic converter can stably achieve a desired purifying capability.

The parameter of the model identified by the identifying means should preferably includes a gain coefficient of the element relative to the response delay. With the gain coefficient of the element relative to the response delay being identified as a parameter by the identifying means, the manipulated variable generated by the manipulated variable generating means using the parameter can accurately reflect the behavior of the object system which has the response delay.

The model comprises a model in which the data of the manipulated variable is regarded as an input quantity given to the object system, the data of the output of the exhaust gas sensor is regarded as an output quantity generated by the object system, and the output quantity in each control cycle is represented by the output quantity and the input quantity in a past control cycle prior to the each control cycle. The model thus constructed is a so-called autoregressive model, and can accurately express the behavior of the object system which has the response delay. In this case, the output quantity (so-called autoregressive term) in the past control cycle is the element relative to the response delay of the object system, and a coefficient relative to the output quantity is a gain coefficient relative to the element of the response delay.

In the case where the model of the object system is constructed as described above, the input quantity preferably comprises the difference between the manipulated variable and a predetermined reference value with respect to the manipulated variable, and the output quantity preferably comprises the difference between output of the exhaust gas sensor and the target value. This makes it easy to construct an algorithm for identifying the parameter with the identifying means and an algorithm for the feedback control process carried out by the manipulated variable generating means.

In the case where the model of the object system is constructed as described above, the parameter of the model identified by the identifying means preferably comprises gain coefficients relative to the output quantity and the input quantity in the past control cycle of the model for increasing the matching (reducing a modeling error) between the behavior of the model and the actual behavior of the object system.

In the air-fuel ratio control system, the catalystic converter included in the object system often has a relatively long dead time. When the rotational speed of the internal combustion engine is relatively low, i.e., when the internal combustion engine is idling, for example, the dead time of the internal combustion engine is also relatively long. The relatively long dead time may present an obstacle in reliably converging the output of the exhaust gas sensor to the target value.

According to the present invention, the model includes an element relative to a dead time of the object system, further comprising estimating means for sequentially generating data representing an estimated value of the output of the exhaust gas sensor after the dead time according to an algorithm constructed based on the model, using the parameter of the model identified by the identifying means, the data of the manipulated variable generated by the manipulated variable generating means, and the data of the output of the exhaust gas sensor, the manipulated variable generating means comprising means for using the data, generated by the estimating means, representing the estimated value of the output of the exhaust gas sensor after the dead time, as the data of the output of the exhaust gas sensor to be used in the feedback control process.

Since the object system is expressed by the model including the element relative to the response delay and the element relative to the dead time, it is possible to sequentially estimate data representing an estimated value of the output of the exhaust gas sensor after the dead time according to an algorithm constructed based on the model, using the parameter of the model identified by the identifying means, the data of the manipulated variable generated by the manipulated variable generating means, and the data of the output of the exhaust gas sensor. Using the identified parameter of the model, it is possible to generate data representing the estimated value depending on the actual behavior of the object system. The manipulated variable generating means comprises means for using the data representing the estimated value of the output of the exhaust gas sensor after the dead time, as the data of the output of the exhaust gas sensor to be used in the feedback control process carried out by the manipulated variable generating means. Therefore, the manipulated variable can be generated while compensating for the effect of the dead time of the object system. As a result, the control process for converging the output of the exhaust gas sensor to the target value can be performed stably and accurately while compensating for the effect of the dead time of the object system.

For generating the data representing the estimated value of the output of the exhaust gas sensor after the dead time, the parameter of the model identified by the identifying means preferably includes a gain coefficient of the element relative to the response delay and a gain coefficient of the element relative to the dead time. This allows the manipulated variable generated by the manipulated variable generating means to accurately reflect the behavior of the object system which has the response delay and the dead time.

The model comprises a model in which the data of the manipulated variable is regarded as an input quantity given to the object system, the data of the output of the exhaust gas sensor is regarded as an output quantity generated by the object system, and the output quantity in each control cycle is represented by the output quantity in a past control cycle prior to the each control cycle and the input quantity in a control cycle prior to the dead time.

The model thus constructed is an autoregressive model with its input quantity containing a dead time. The model is capable of accurately expressing the behavior of the object system which has the response delay and the dead time. In this case, the output quantity (so-called autoregressive term) in the past control cycle is the element relative to the response delay of the object system, and a coefficient relative to the output quantity is a gain coefficient relative to the element of the response delay. The input quantity in the control cycle prior to the dead time is the element relative to the dead time of the object system, and a coefficient relative to the input quantity is a gain coefficient relative to the element of the dead time.

In the case where the model of the object system is constructed as described above, the input quantity preferably comprises the difference between the manipulated variable and a predetermined reference value with respect to the manipulated variable, the output quantity preferably comprises the difference between output of the exhaust gas sensor and the target value, and the data, generated by the estimating means, representing the estimated value of the output of the exhaust gas sensor after the dead time preferably comprises the difference between the estimated value and the target value. This allows an algorithm for the identifying means to identify the parameter, an algorithm of the estimating means, and an algorithm of the feedback control process carried out by the manipulated variable generating means to be constructed with ease.

In the case where the model of the object system is constructed as described above, the parameter of the model identified by the identifying means preferably comprises gain coefficients relative to the output quantity in the past control cycle of the model and the input quantity in the control cycle prior to the dead time for increasing the matching (reducing a modeling error) between the behavior of the model and the actual behavior of the object system.

For generating the manipulated variable using the data representing the estimated value of the output of the exhaust gas sensor after the dead time, the feedback control process performed by the manipulated variable generating means specifically comprises a process for generating the manipulated variable in order to converge the estimated value of the output of the exhaust gas sensor after the dead time to the target value. According to this process, the control process for converging the output of the exhaust gas sensor to the target value can stably be performed while appropriately compensating for the effect of the dead time.

Regardless of whether the estimating means is provided or not, the manipulated variable comprises a target air-fuel ratio for the air-fuel mixture, the air-fuel ratio manipulating means comprising means for manipulating the air-fuel ratio of the air-fuel mixture into the target air-fuel ratio depending on the target air-fuel ratio according to a feed-forward control process.

With the manipulated variable comprising a target air-fuel ratio for the air-fuel mixture, the target air-fuel ratio is generated while taking into account the overall behavior of the object system including the internal combustion engine, the air-fuel ratio manipulating means, the catalytic converter, and the exhaust gas sensor. When the air-fuel ratio of the air-fuel mixture to be combusted by the internal combustion engine is manipulated into the target air-fuel ratio depending on the target air-fuel ratio according to the feed-forward control process, the air-fuel ratio of the air-fuel mixture can be manipulated into an air-fuel ratio suitable for converging the output of the exhaust gas sensor to the target value irrespective of the behavior of the object system. Inasmuch as the air-fuel ratio of the air-fuel mixture to be combusted by the internal combustion engine is manipulated depending on the target air-fuel ratio according to the feed-forward control process, the processing of the air-fuel manipulating means for manipulating the air-fuel ratio of the air-fuel mixture is simplified.

For manipulating the air-fuel ratio of the air-fuel mixture to be combusted by the internal combustion engine depending on the target air-fuel ratio according to the feed-forward control process, a corrective variable for the fuel supply quantity of the internal combustion engine may be determined in advance using a predetermined data table, a map, etc., and the fuel supply quantity of the internal combustion engine may be corrected by the determined corrective variable.

The corrective variable for the fuel supply quantity of the internal combustion engine may be generated as the manipulated variable.

In the air-fuel ratio control system, if the value of the parameter identified by the identifying means is inappropriate, then the manipulated variable generated by the manipulated variable generating means using the parameter may also be inappropriate in converging the output of the exhaust gas sensor to the target value.

The inventors of the present application has found that even if the manipulated variable is appropriate in converging the output of the exhaust gas sensor to the target value, the manipulated variable may tend to cause frequency variations (oscillating variations at a high frequency) in the air-fuel ratio of the air-fuel mixture manipulated based on the manipulated variable. In this case, the manipulated variable poses no problem for converging the output of the exhaust gas sensor to the target value and enabling the catalytic converter to achieve a desired purifying capability. However, frequent variations caused in the air-fuel mixture to be combusted by the internal combustion engine are liable to make the internal combustion engine operate unstably.

The inventors of the present application has also found that, if the estimating means is provided and when the estimating means generates data representing an estimated value of the output of the exhaust gas sensor after the dead time according to predetermined calculations from the data of the manipulated variable generated by the manipulated variable generating means, the data of the output of the exhaust gas sensor, and a plurality of coefficients determined by the value of the parameter identified by the identifying means, combinations of the plurality of coefficients tend to affect whether the manipulated variable and the air-fuel mixture manipulated thereby cause frequency variations or not.

According to the present invention, therefore, the identifying means comprises means for limiting the parameter to be identified to a value which satisfies a predetermined condition.

If the estimating means comprises means for generating the data representing the estimated value of the output of the exhaust gas sensor after the dead time according to predetermined calculations from the data of the manipulated variable generated by the manipulated variable generating means, the data of the output of the exhaust gas sensor, and a plurality of coefficients determined by the value of the parameter identified by the identifying means, then the predetermined condition for limiting the parameter to be identified by the identifying means is established to set the plurality of coefficients determined by the value of the parameter to a predetermined combination.

With the value of the parameter identified by the identifying means being limited so as to satisfy the predetermined condition, the manipulate variable generated by the manipulated variable generating means using the parameter is prevented from becoming inappropriate in converging the output of the exhaust gas sensor to the target value, or the manipulated variable and the air-fuel ratio of the air-fuel mixture to be combusted by the internal combustion engine are prevented from suffering frequent variations.

The predetermined condition may be determined through experiments and simulations.

If the identifying means comprises means for identifying a plurality of parameters, then the predetermined condition comprises a condition (e.g., a range of parameter values) for limiting the value of each of the parameters, and preferably a condition for limiting at least two of the parameters to a predetermined combination.

In this manner, the values of individual parameters are not excessively limited, but can optimally be identified for converging the output of the exhaust gas sensor to the target value, and stabilizing the manipulated variable and hence the air-fuel ratio of the air-fuel mixture (smoothing time-depending changes of the manipulated variable and the air-fuel ratio).

For limiting the value of the parameter, the predetermined condition comprises a condition for limiting upper and lower limits for at least one the parameter to be identified by the identifying means.

Generally, if the value of the identified parameter is too large or small, then the reliability of the parameter is low. Even when the manipulated variable is generated and the air-fuel ratio of the air-fuel mixture is manipulated using the parameter, it is often impossible to accurately control the output of the exhaust gas sensor at the target value. For this reason, the predetermined condition comprises a condition for limiting upper and lower limits for at least one parameter. This is effective in preventing the value of the parameter from becoming excessively large or small, and hence preventing the controllability of the output of the exhaust gas sensor at the target value from being lowered.

If the identifying means comprises means for identifying the parameter according to an algorithm for updating and identifying the parameter using a value thereof in a past control cycle in each control cycle, then the value of the parameter in the past control cycle should preferably be limited to a value which satisfies the predetermined condition.

Since the value of the parameter is updated and identified using the past value limited to the value which satisfies the predetermined condition, the value of the parameter which satisfies the predetermined condition can easily be identified.

For limiting the value of the parameter, the element relative to the response delay includes primary and secondary autoregressive terms relative to the output of the exhaust gas sensor, the parameter to be identified by the identifying means includes first and second gain coefficients relative to the primary and secondary autoregressive terms, respectively, and the predetermined condition is established such that a point in a coordinate plane which is determined by two coordinates represented by values of the first and second gain coefficients exists in a predetermined range in the coordinate plane.

With the predetermined condition for limiting the values of the first and second gain coefficients being established by a predetermined range in the coordinate plane, the values of the first and second gain coefficients can be limited to a suitable combination.

When the model of the object system is such that the output quantity of the object system in each control cycle is represented by the output quantity in the past control cycle, the primary autoregressive term represents the term of the output quantity in a preceding control cycle, and the secondary autoregressive term represents the term of the output quantity in a control cycle which precedes the preceding control cycle.

For establishing the predetermined condition with a predetermined range in the coordinate plane, the predetermined range may have a boundary of any shape, but should preferably have a linear boundary.

The boundary of the predetermined range can thus be expressed by a simple function (including a constant-valued function parallel to a coordinate axis. As a result, whether the values of the first and second gain coefficients satisfy the predetermined condition or not (whether the point in the coordinate plane determined by the coordinates represented by the values of the first and second gain coefficients exists in the predetermined range or not) can easily be determined, and the process for limiting the values of the first and second gain coefficients to values which satisfy the predetermined condition can easily be performed.

The predetermined range has a boundary including at least a portion which is defined by a predetermined function having the first and second gain coefficients as variables.

The predetermined condition defined by the predetermined range can thus be established by a correlated combination of the values of the first and second gain coefficients. It is possible to set up the predetermined condition optimum for controlling the output of the exhaust gas sensor at the target value and generating a stable manipulated variable (a smoothly varying manipulated variable) with the manipulated variable generating means.

With the predetermined range being set for limiting the values of the first and second gain coefficients, the identifying means comprises means for, if the point in the coordinate plane which is determined by the values of the first and second gain coefficients identified based on the data of the manipulated variable and the data of the output of the exhaust gas sensor deviates from the predetermined range, changing the values of the first and second gain coefficients to values of points in the predetermined range so as to minimize a change in the value of the first gain coefficient for thereby limiting the values of the first and second gain coefficients.

Of the first gain coefficient relative to the primary autoregressive term of the model and the second gain coefficient relative to the secondary autoregressive term of the model, the value of the former gain coefficient is more important than the value of the latter gain coefficient in keeping reliable the manipulated variable generated by the manipulated variable generating means. This is because the autoregressive term of a lower order (newer autoregressive term) is highly correlated to the present output of the object system (the output of the exhaust gas sensor) and highly reliable. Therefore, if the point in the coordinate plane which is determined by the values of the first and second gain coefficients which are identified deviates from the predetermined range, then when the value of the first gain coefficient is varied too largely in order to limit the values of the first and second gain coefficients to values in the predetermined range, the controllability of the output of the exhaust gas sensor at the manipulated variable may be impaired. According to the present invention, for limiting the values of the first and second gain coefficients, the values of the first and second gain coefficients are changed to values of points in the predetermined range so as to minimize a change in the value of the first gain coefficient. Consequently, the controllability of the output of the exhaust gas sensor at the manipulated variable is prevented from being impaired by limiting the values of the first and second gain coefficients.

The identifying means preferably comprises means for identifying the parameter according to an algorithm for identifying the parameter of the model in order to minimize an error between the output of the exhaust gas sensor in the model and an actual output of the exhaust gas sensor, and the air-fuel ratio control system should further comprise means for filtering the output of the exhaust gas sensor in the model and the actual output of the exhaust gas sensor with the same frequency characteristics in calculating the error with the identifying means.

With this arrangement, it is possible to identify the parameter to cause the frequency characteristics of the object system and the model (more specifically, the frequency characteristics of a change in the output of the exhaust gas sensor (corresponding to the output quantity of the model) with respect to a change in the manipulated variable (corresponding to the input quantity of the model)) to match each other. As a consequence, the value of the identified parameter is made highly reliable, and the manipulated variable generated using the parameter is made adequate for converging the output of the exhaust gas sensor to the target value.

Only the output of the exhaust gas sensor in the model (the output of the exhaust gas sensor calculated in the model from the data of the manipulated variable) and the actual output of the exhaust gas sensor may be filtered. The error may be determined after the error is filtered or the output of the exhaust gas sensor in the model and the actual output of the exhaust gas sensor are filtered.

The feedback control process performed by the manipulated variable generating means may comprise a sliding mode control process. The sliding mode control process may comprise an adaptive sliding mode control process.

The sliding mode control process, which is one feedback control process using a model of an object to be controlled, is generally highly stable against disturbances and modeling errors. The manipulated variable generated according to the sliding mode control process is highly reliable, making it possible to converge the output of the exhaust gas sensor highly stably to the target value.

The adaptive sliding mode control process is characterized by a control law known as a so-called an adaptive control law (adaptive algorithm) added to the normal sliding mode control process in order to eliminate the effect of disturbances and modeling errors as much as possible. Therefore, the adaptive sliding mode control process is effective to increase the stability of the control process for converging the output of the exhaust gas sensor to the target value. More specifically, the sliding mode control process employs a function referred to as a switching function composed of the difference between a controlled variable (the output of the exhaust gas sensor in this invention) and its target value, and it is important to converge the value of the switching function stably to "0". According to the normal sliding mode control process, a control law referred to as a reaching control law is employed to converge the value of the switching function to "0". Due to the effect of disturbances, etc., however, it may be difficult to converge the value of the switching function stably to "0" sufficiently stably only with the reaching control law. The adaptive sliding mode control process additionally employs the control law known as the adaptive control law (adaptive algorithm) in addition to the reaching control law for converging the value of the switching function to "0" while eliminating the effect of disturbances and modeling errors as much as possible. When the manipulated variable is generated according to the adaptive sliding mode control process, the value of the switching function can highly stably be converged to "0", and the manipulated variable can be generated so as to be able to converge the output of the exhaust gas sensor highly stably to the target value.

The sliding mode control process (including the adaptive sliding mode control process) used as the feedback control process should preferably employ a linear function having as elements a plurality of time-series data of the difference between the output of the exhaust gas sensor and the target value, as a switching function for the sliding mode control process.

When the adaptive sliding mode control process is employed as the feedback control process, the input quantity (the data representing the manipulated variable) to be given to the object system expressed by the model is basically determined as the sum of a component (so-called an equivalent control input) based on the control law for converging the value of the switching function to "0", a component for converging the value of the switching function to "0" based on the reaching control law, and a component for converging the value of the switching function to "0" while eliminating the effect of disturbances, etc. based on the adaptive control law. When the normal sliding mode control process is employed, the component based on the adaptive control law is dispensed with, and the sum of the equivalent control input and the component based on the reaching control law is determined as the input quantity.

When the sliding mode control process (including the adaptive sliding mode control process) is used as the feedback control process, the air-fuel ratio control system should further comprise means for determining the stability of a control process for converging the output of the exhaust gas sensor to the target value according to the sliding mode control process, the manipulated variable generating means comprising means for limiting the manipulated variable to be given to the air-fuel ratio manipulating means to a predetermined value or a value in a predetermined range when the control process is judged as being unstable.

In a situation where the control process for converging the output of the exhaust gas sensor to the target value according to the sliding mode control process is judged as being unstable, the output of the exhaust gas sensor tends to behave unstably with respect to the target value. According to the present invention, therefore, in a situation where the control process is judged as being unstable, the manipulated variable given from the manipulated variable generating means to the air-fuel ratio manipulating means is limited to a predetermined value (e.g., a present value or a predetermined fixed value) or a value in a predetermined range (e.g., a sufficiently narrow fixed range). The manipulated variable which is given to the air-fuel ratio manipulating means is now limited against variations, and hence the air-fuel ratio of the air-fuel mixture manipulated depending on the manipulated variable is prevented from unduly varying. As a result, the output of the exhaust gas sensor can be stabilized.

The means for determining the stability of the control process comprises means for determining the stability of the control process based on the value of switching function for the sliding mode control process.

According to the sliding mode control process, as described above, it is important to converge the value of the switching function to "0" in converging the controlled variable (the output of the exhaust gas sensor) to the target value. Therefore, the stability of the control process for converging the output of the exhaust gas sensor to the target value can be determined on the basis of the value of the switching function.

For example, if the product of the value of the switching function and the range of change thereof (which corresponds to the time-differentiated function of a Lyapunov function relative to the switching function) is determined, then when the determined product is of a positive value, the value of the switching function is getting away from "0", and when the determined product is of a negative value, the value of the switching function is getting toward "0". Therefore, it is basically possible to determined whether the control process for converging the output of the exhaust gas sensor to the target value is stable or unstable based on whether the value of the above product is positive or negative. The stability of the above control process can also be determined by comparing the magnitude of the value of the switching function or the range of change thereof with a suitable value.

For enabling the catalytic converter to achieve an optimum purifying capability, it is preferable to employ an oxygen concentration sensor ($O_2$ sensor) as the exhaust gas sensor, and to set a target value for the output of the sensor to a predetermined constant value.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
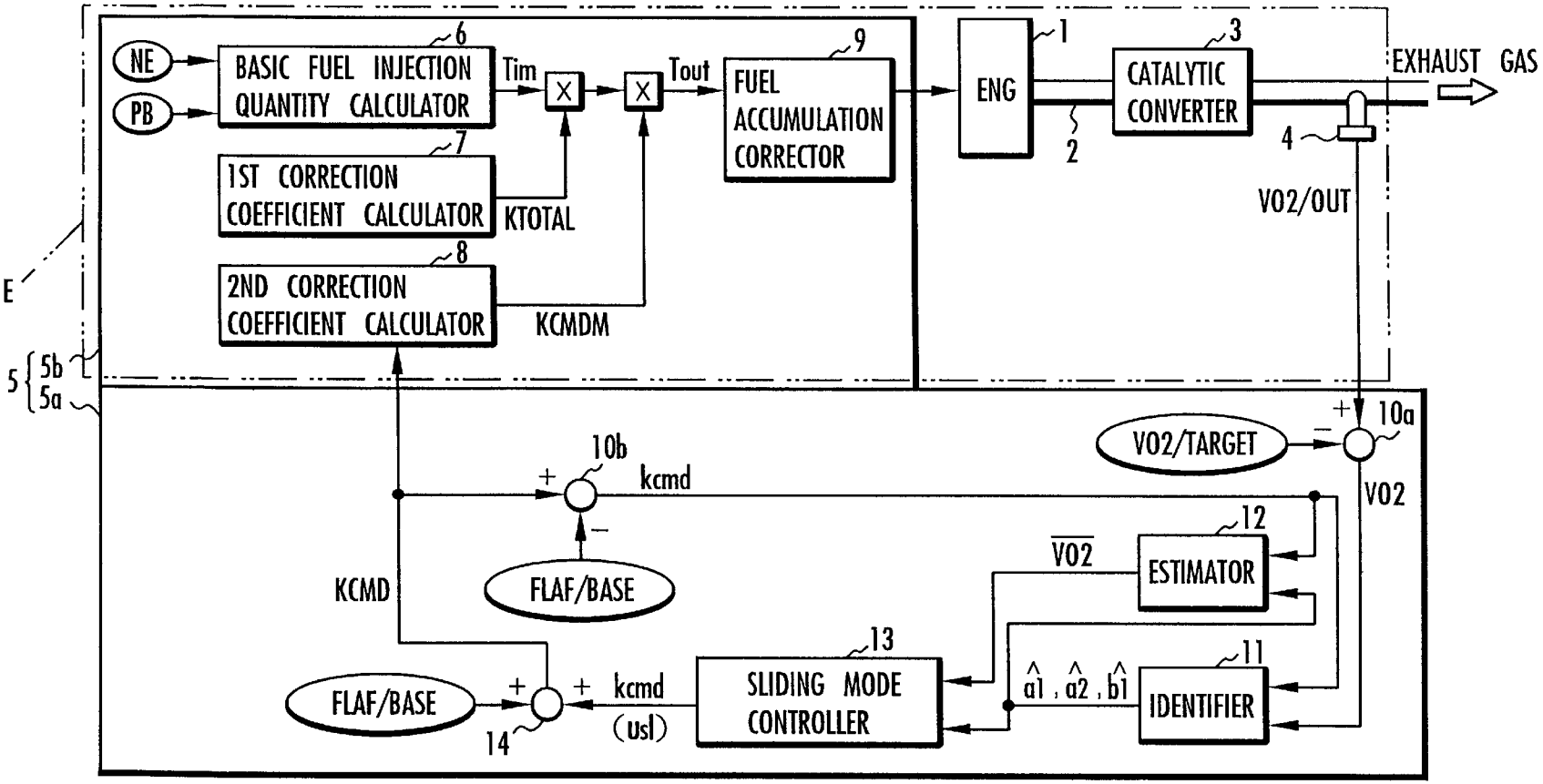
FIG. 1 is a block diagram of an overall system arrangement of an air-fuel ratio control system for an internal combustion engine according to the present invention.

FIG. 1 shows in block form an overall system arrangement of an air-fuel ratio control system for an internal combustion engine according to the present invention. As shown in FIG. 1, a four-cylinder internal combustion engine 1 is mounted as a propulsion source on an automobile or a hybrid vehicle, i.e., a drive source for drive wheels thereof. The internal combustion engine 1 generates exhaust gases produced by combustion of an air-fuel mixture in the cylinders. The exhaust gases are collected into a common discharge pipe 2 (exhaust passage) positioned near the internal combustion engine 1, from which the exhaust gas is discharged into the atmosphere. A catalytic converter 3 comprising a three-way catalytic converter for purifying the exhaust gases is mounted in the common exhaust pipe 2.

The air-fuel ratio control system serves to control an air-fuel ratio of the internal combustion engine 1 (more accurately, the air-fuel ratio of an air-fuel mixture combusted by the internal combustion engine 1) in order to enable the catalytic converter 3 to achieve optimum exhaust gas purifying performance. The air-fuel ratio control system comprises an $O_2$ sensor (oxygen concentration sensor) 4 mounted on the exhaust pipe 2 downstream of the catalytic converter 3, and a control unit 5 for carrying out a control process (described later on) based on a detected output signal from the $O_2$ sensor 4. The control unit 5 is supplied with a detected output signal from the $O_2$ sensor 4 and also detected output signals from various other sensors for detecting operating conditions of the internal combustion engine 1, including a engine speed, an intake pressure, a coolant temperature, etc.

Figure 2:
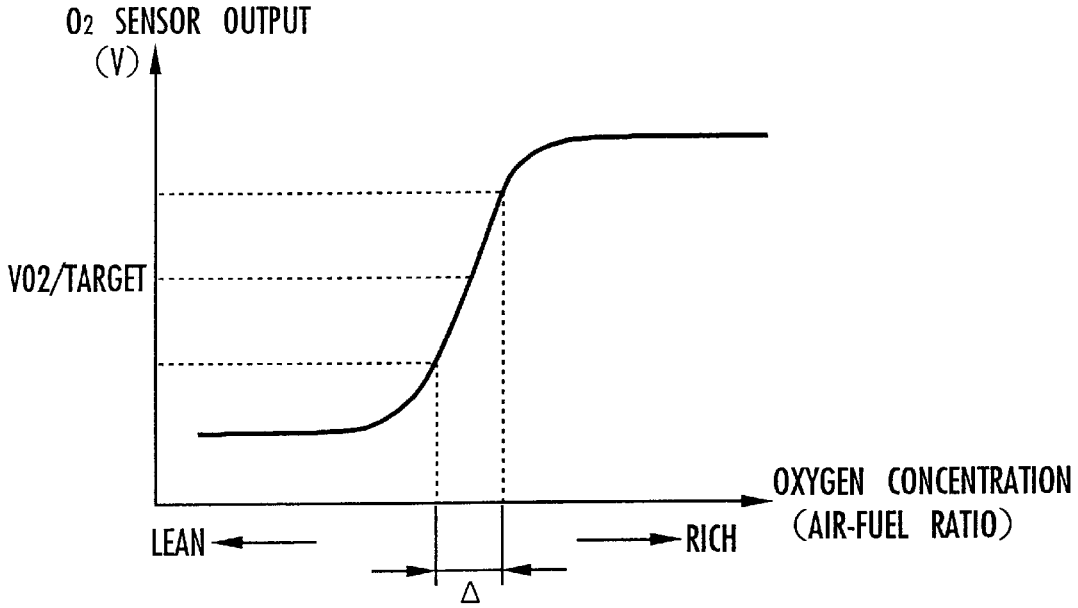
FIG. 2 is a diagram showing output characteristics of an $O_2$ sensor used in the air-fuel ratio control system shown in FIG. 1.

The $O_2$ sensor 4 generates an output signal VO2/OUT having a level depending on the oxygen concentration in the exhaust gas that has passed through the catalystic converter 3, i.e., an output signal VO2/OUT representing a detected value of the oxygen concentration in the exhaust gas. Since the oxygen concentration in the exhaust gas that flows through the exhaust pipe 2 including the catalytic converter 3 depends on the air-fuel ratio of the air-fuel mixture combusted by the internal combustion engine 1, he output signal VO2/OUT from the $O_2$ sensor 4 also depends on the air-fuel ratio of the air-fuel mixture combusted by the internal combustion engine 1. The output signal VO2/OUT from the $O_2$ sensor 4 will change with high sensitivity in substantial proportion to the oxygen concentration in the exhaust gas, with the air-fuel ratio corresponding to the oxygen concentration in the exhaust gas that has passed through the catalytic converter 3 being in a range Δ close to a stoichiometric air-fuel ratio, as shown in FIG. 2.

The control unit 5 basically performs a process for manipulating the air-fuel ratio of the internal combustion engine 1 to converge (set) the output signal VO2/OUT from the $O_2$ sensor 4 to a predetermined target value VO2/TARGET (constant value, see FIG. 2) in order to enable the catalytic converter 3 to have an optimum purifying capability. The air-fuel ratio control system according to the illustrated embodiment thus enables the catalytic converter 3 to have an optimum purifying capability irrespective of the aging of the catalytic converter 3 while the air-fuel ratio of the internal combustion engine 1 is in a state to set the output signal VO2/OUT from the $O_2$ sensor 4 disposed downstream of the catalytic converter 3 to a predetermined constant value. The control unit 5 uses the predetermined constant value as the target value VO2/TARGET for the output signal VO2/OUT from the $O_2$ sensor 4, and manipulates the air-fuel ratio of the internal combustion engine 1 in order to converge the output signal VO2/OUT from the $O_2$ sensor 4 to the target value VO2/TARGET.

The control unit 5 for carrying out the above process comprises a microcomputer. The control unit 5 is functionally divided into a controller 5*a* (hereinafter referred to as an "air-fuel ratio processing controller 5*a*") for performing in predetermined control cycles a process for successively generating a target air-fuel ratio KCMD, which is a target value for the air-fuel ratio of the internal combustion engine 1, as a manipulated variable for manipulating the air-fuel ratio of the internal combustion engine 1, and a controller 5*b* (hereinafter referred to as a "fuel processing controller 5*b*") for performing in predetermined control cycles a process for determining a fuel injection quantity (amount of fuel to be supplied) of the internal combustion engine 1, i.e., a process for generating a command value for the fuel injection quantity, using data of the generated target air-fuel ratio KCMD.

The target air-fuel ratio KCMD generated by the air-fuel ratio processing controller 5*a* is basically an air-fuel ratio of the internal combustion engine 1 required to converge the output signal VO2/OUT of the $O_2$ sensor 4 (the detected value of the oxygen concentration) to the target value VO2/TARGET.

The air-fuel ratio processing controller 5*a* corresponds to a manipulated variable generating means, and the fuel processing controller 5*b* corresponds to an air-fuel ratio manipulating means.

Control cycles in which the air-fuel ratio processing controller 5*a* and the fuel processing controller 5*b* perform the respective processes will be described below.

The air-fuel ratio processing controller 5*a* controls a system (hereinafter referred to as an "object system E") comprising the fuel processing controller 5*b*, the internal combustion engine 1, the catalytic converter 3, and the $O_2$ sensor 4 and including the exhaust pipe 2 from the internal combustion engine 1 to the $O_2$ sensor 4 (within the imaginary-line frame represented by E), i.e., a system for generating the output signal VO2/OUT of the $O_2$ sensor 4 from the target air-fuel ratio KCMD. The air-fuel ratio processing controller 5*a* performs a process for generating the target air-fuel ratio KCMD as an input quantity (so-called control input) to be given to the object system E for converging the output signal VO2/OUT of the $O_2$ sensor 4, as an output quantity of the object system E, to the target value VO2/TARGET.

The object system E has a relatively long dead time due to the catalytic converter 3. In the illustrated embodiment, the air-fuel ratio processing controller 5*a* is placed under a relatively large calculating load because it compensates for the dead time of the object system E and the effect of behavioral changes, as described later on, in order to generate the target air-fuel ratio KCMD.

The control cycles of the process performed by the air-fuel ratio processing controller 5*a* for generating the target air-fuel ratio KCMD are of a constant period (e.g., 30–100 ms) in view of the dead time of the object system E, the calculating load, etc.

The process carried out by the fuel processing controller 5*b* for determining a fuel injection quantity of the internal combustion engine 1 is required to be synchronous with the rotational speed (specifically, the combustion cycles) of the internal combustion engine 1. The control cycles of the process performed by the fuel processing controller 5*b* are of a period in synchronism with a crankshaft angle period (so-called TDC) of the internal combustion engine 1.

The constant period of the control cycles of the air-fuel ratio processing controller 5*a* is longer than the crankshaft angle period (TDC).

Based on the above definitions, the fuel processing controller 5*b* and the air-fuel ratio processing controller 5*a* will be described in greater detail below.

The fuel processing controller 5*b* has, as its functional components, a basic fuel injection quantity calculator 6 for determining a basic fuel injection quantity Tim to be injected into the internal combustion engine 1, a first correction coefficient calculator 7 for determining a first correction coefficient KTOTAL to correct the basic fuel injection quantity Tim, a second correction coefficient calculator 8 for determining a second correction coefficient KCMDM to correct the basic fuel injection quantity Tim, and a fuel accumulation corrector 9 for correcting an output fuel injection quantity Tout, produced by correcting the basic fuel injection quantity Tim with the first correction coefficient KTOTAL and the second correction coefficient KCMDM, in view of accumulated fuel particles on intake pipe walls (not shown) of the internal combustion engine 1.

The basic fuel injection quantity calculator 6 determines a reference fuel injection quantity for the internal combustion engine 1 from the rotational speed NE and intake pressure PB, which are detected by non-illustrated sensors, using a predetermined map, and corrects the determined reference fuel injection quantity depending on the effective opening area of a throttle valve (not shown) of the internal combustion engine 1, thereby calculating a basic fuel injection quantity Tim. The basic fuel injection quantity Tim is basically a fuel injection quantity for equalizing the ratio of the amount of air introduced into the combustion chamber (not shown) and the basic fuel injection quantity Tim per crankshaft angle period (1 TDC) of the internal combustion engine 1, i.e., the air-fuel ratio, to a stoichiometric air-fuel ratio.

The first correction coefficient KTOTAL determined by the first correction coefficient calculator 7 serves to correct the basic fuel injection quantity Tim in view of an exhaust gas recirculation ratio of the internal combustion engine 1, i.e., the proportion of an exhaust gas contained in an air-fuel mixture introduced into the internal combustion engine 1, an amount of purged fuel supplied to the internal combustion engine 1 when a canister (not shown) is purged, a coolant temperature, an intake temperature, etc. of the internal combustion engine 1.

The second correction coefficient KCMDM determined by the second correction coefficient calculator 8 serves to correct the basic fuel injection quantity Tim according to a feed-forward control process in order to manipulate the air-fuel ratio of the air-fuel mixture combusted by the internal combustion engine 1 into the target air-fuel ratio KCMD, and is determined from the target air-fuel ratio KCMD using a predetermined data table (not shown). The second correction coefficient KCMDM determined using the data table is "1" when the target air-fuel ratio KCMD is the same as the stoichiometric air-fuel ratio, and is of a value greater than "1" when the target air-fuel ratio KCMD is of a value richer than the stoichiometric air-fuel ratio. The second correction coefficient KCMDM is of a value smaller than "1" as the target air-fuel ratio KCMD is of a value leaner than the stoichiometric air-fuel ratio. More specifically, the second correction coefficient KCMDM is of a value produced by correcting the reciprocal of the ratio of the target air-fuel ratio KCMD to the stoichiometric air-fuel ratio (the target air-fuel ratio KCMD/the stoichiometric air-fuel ratio) in view of the charging efficiency of an air-fuel mixture due to the cooling effect of fuel injected into the internal combustion engine 1.

The fuel processing controller 5*b* corrects the basic fuel injection quantity Tim with the first correction coefficient KTOTAL and the second correction coefficient KCMDM by multiplying the basic fuel injection quantity Tim by the first correction coefficient KTOTAL and the second correction coefficient KCMDM, thus producing an output fuel injection quantity Tout to be supplied to the internal combustion engine 1. The fuel accumulation corrector 9 corrects the output fuel injection quantity Tout in view of accumulated fuel particles on intake pipe walls (not shown) of the internal combustion engine 1, thus determining a final command value for the fuel injection quantity, which is supplied to fuel injectors (not shown) of the internal combustion engine 1.

Specific details of processes for calculating the basic fuel injection quantity Tim, the first correction coefficient KTOTAL, and the second correction coefficient KCMDM are disclosed in detail in Japanese laid-open patent publication No. 5-79374 and U.S. Pat. No. 5,253,630, and will not be described below. The correction of the output fuel injection quantity performed by the fuel accumulation corrector 9 is disclosed in detail in Japanese laid-open patent publication No. 8-21273 and U.S. Pat. No. 5,568,799, for example, and will not be described in detail below.

The air-fuel ratio processing controller 5*a* successively generates, in predetermined control cycles (constant period), a target air-fuel ratio KCMD which is to be given as an input quantity (control input) to the object system E for converging the output signal VO2/OUT from the $O_2$ sensor 4 to the target value VO2/TARGET, according to a sliding mode control process (more specifically, an adaptive sliding mode control process), which is one type of feedback control process, in view of the response delay and dead time of the object system E and behavioral changes of the object system E.

For generating the target air-fuel ratio KCMD, the object system E is regarded as a system for generating the difference VO2 (=VO2/OUT−VO2/TARGET, hereinafter referred to as a "differential output VO2") between the $O_2$ sensor 4 and the target value VO2/TARGET with a response delay and a dead time, from the difference kcmd (=KCMD−FLAF/BASE, hereinafter referred to as a "target differential air-fuel ratio kcmd") between the target air-fuel ratio KCMD generated by the air-fuel ratio processing controller 5*a* and a reference value FLAF/BASE for the air-fuel ratio of the internal combustion engine 1, and the behavior of such a system is modeled in advance. In the present embodiment, specifically, the input quantity of the object system E is regarded as the target differential air-fuel ratio kcmd, and the output quantity of the object system E is regarded as the differential output VO2" of the $O_2$ sensor 4, and the model representing the behavior of the object system E is constructed from those input and output quantities. The reference value FLAF/BASE (hereinafter referred to as an "air-fuel ratio reference value FLAF/BASE") for the air-fuel ratio of the internal combustion engine 1 is of a given constant value which is a substantially central value of target air-fuel ratios KCMD or actual air-fuel ratios of the internal combustion engine 1 that are manipulated depending on the target air-fuel ratios KCMD.

The model representing the behavior of the object system E (hereinafter referred to as an "object system model") is expressed as a model of a discrete-time system (more specifically, an autoregressive model having a dead time in the target differential air-fuel ratio kcmd as an input quantity to the object system E) according to the following equation (1):

$$VO2(k+1)=a1\cdot VO2(k)+a2\cdot VO2(k-1)+b1\cdot kcmd(k-d) \quad (1)$$

where "k" represents the number of a discrete-time control cycle of the air-fuel ratio processing controller 5*a,* and "d" the dead time present in the object system E as expressed by a time in terms of the number of control cycles, required until the target differential air-fuel ratio kcmd or the target air-fuel ratio KCMD in each control cycle is reflected in the differential output VO2 or output signal VO2/OUT of the $O_2$ sensor 4. The actual dead time of the object system E is essentially the sum of the dead time of the catalytic converter 3 and the dead time of the internal combustion engine 1 and the fuel processing controller 5*b*. The latter dead time is longer as the rotational speed of the internal combustion engine 1 is lower. In present embodiment, longer than the actual dead time of the object system E in low rotational speed range (e.g., an idling rotational speed) of the internal combustion engine 1 is used as the dead time d in the object system model as represented by the equation (1).

The first and second terms of the right side of the equation (1) correspond to a response delay of the object system E, the first term being a primary autoregressive term and the second term being a secondary autoregressive term. In the first and second terms, "a1", "a2" represent respective gain coefficients of the primary autoregressive term and the secondary autoregressive term. Stated otherwise, these gain coefficients "a1", "a2" are coefficients relative to the differential output VO2 of the $O_2$ sensor 4 as the output quantity of the object system E in the object system model.

The third term of the right side of the equation (1) is an element relative to the dead time d of the object system E, and, more accurately, represents the target differential air-fuel ratio kcmd as the input quantity to the object system E, including the dead time d of the object system E. In the third term, "b1" represents a gain coefficient relative to the above element, i.e., a gain coefficient relative to the target differential air-fuel ratio kcmd as the input quantity to the object system E.

The gain coefficients "a1", "a2", "b1" are parameters which are set to be set (identified) to values in defining the behavior of the object system model, and are sequentially identified by an identifier which will be described later on.

In the object system model expressed as the discrete time system according to the equation (1), the differential output VO2(k+1) of the $O_2$ sensor 4 as the output quantity of the object system E in each control cycle of the air-fuel ratio processing controller 5*a* is expressed by a plurality of (two in this embodiment) differential outputs VO2(k), VO2(k−1) in past control cycles prior to the control cycle (more specifically, the differential output VO2(k) in a preceding control cycle and the differential output VO2(k−1) in a control cycle which precedes the preceding control cycle, and a target differential air-fuel ratio kcmd(k−d) as the input quantity to the object system E prior to the dead time d.

The air-fuel ratio processing controller 5*a* carries out the process constructed on the basis of the object system model expressed by the equation (1) in predetermined control cycles (constant period), to sequentially generate the target differential air-fuel ratio kcmd as the input quantity to be given to the object system E for converging the output VO2/OUT of the $O_2$ sensor 4 to its target value VO2/TARGET. The air-fuel ratio processing controller 5*a* also adds the air-fuel ratio reference value FLAF/BASE to the target differential air-fuel ratio kcmd for thereby sequentially generating a target air-fuel ratio KCMD to be given to the fuel processing controller 5*b*. In order to perform the above process, the air-fuel ratio processing controller 5*a* has its functional components as shown in FIG. 1.

Specifically, the air-fuel ratio processing controller 5*a* comprises a subtractor 10*a* for subtracting the target value VO2/TARGET from the output VO2/OUT of the $O_2$ sensor 4 to sequentially calculate the differential output VO2, a subtractor 10*b* for subtracting the air-fuel ratio reference value FLAF/BASE from the target air-fuel ratio KCMD, which is finally generated in each control cycle by the air-fuel ratio processing controller 5*a,* to sequentially calculate the target differential air-fuel ratio kcmd as the input quantity actually given to the object system E, an identifier 11 (identifying means) for sequentially identifying the gain coefficients a1, a2, b1 that are parameters to be established for the object system model E, an estimator 12 (estimating means) for sequentially determining an estimated value VO2 bar of the differential output VO2 from the $O_2$ sensor 4 (hereinafter referred to as an "estimated differential output VO2 bar") after the dead time d of the object system E, as data representing an estimated value (predicted value) of the output VO2/OUT of the $O_2$ sensor 4 after the dead time d, a sliding mode controller 13 for sequentially determining in each control cycle the target differential air-fuel ratio kcmd to converge the output of the $O_2$ sensor 4 to the target value VO2/TARGET according to the adaptive sliding mode control process, and an adder 14 for adding the air-fuel ratio reference value FLAF/BASE to the target differential air-fuel ratio kcmd thereby to sequentially calculate the target air-fuel ratio KCMD.

The algorithm of a processing operation to be carried out by the identifier 11, the estimator 12, and the sliding mode controller 13 is constructed as follows:

The identifier 11 serves to sequentially calculate identified values a1 hat, a2 hat, b1 hat of the respective gain coefficients a1, a2, b1 (hereinafter referred to as "identified gain coefficients a1 hat, a2 hat, b1 hat") sequentially on a real-time basis for the purpose of minimizing a modeling error of the actual object system E of the object system model expressed by the equation (1). The identifier 11 carries out its identifying process as follows:

In each control cycle of the air-fuel ratio processing controller 5*a,* the identifier 11 determines an identified value VO2(k) hat of the differential output VO2 (the output quantity of the object system model) from the $O_2$ sensor 4 (hereinafter referred to as an "identified differential output VO2(k) hat") in the present control cycle on the object system model, using the identified gain coefficients a1 hat, a2 hat, b1 hat of the presently established object system model, i.e., identified gain coefficients a1 hat (k−1), a2 hat (k−1), b1 hat (k−1) determined in a preceding control cycle, past data of the differential output VO2 of the $O_2$ sensor 4 calculated by the subtractor 10*a* (more specifically, the differential output VO2(k−1) in a preceding control cycle and the differential output VO2(k−2) in a control cycle which precedes the preceding control cycle), and past data of the target differential air-fuel ratio kcmd calculated by the subtractor 10*b* (more specifically, the target differential air-fuel ratio kcmd(k−d−1) in a control cycle which is (d+1) control cycles ago, according to the following equation (2):

$$\hat{VO2}(k)=\hat{a1}(k-1)\cdot VO2(k-1)+\hat{a2}(k-1)\cdot VO2(k-2)+\hat{b1}(k-1)\cdot kcmd(k-d-1) \quad (2)$$

The equation (2) corresponds to the equation (1) which is shifted into the past by one control cycle with the gain coefficients a1, a2, b1 being replaced with the respective identified gain coefficients a1 hat (k−1), a2 hat (k−1), b1 hat (k−1). The value of the dead time "d" of the object system E in the third term of the equation (2) represents a preset constant value as described above.

If vectors Θ, ν defined by the following equations (3), (4) are introduced (the letter T in the equations (3), (4) and other equations represents a transposition), then the equation (2) is expressed by the equation (5):

$$\Theta^T(k)=[\hat{a}1(k)\hat{a}2(k)\hat{b}1(k)] \tag{3}$$

$$\xi^T(k)=[VO2(k-1)VO2(k-2)kcmd(k-d-1)] \tag{4}$$

$$V\hat{O}2(k)=\Theta^T(k-1)\cdot\xi(k) \tag{5}$$

The identifier 11 also determines a difference id/e between the identified differential output VO2 hat from the $O_2$ sensor 4 which is determined by the equation (2) or (5) and the present differential output VO2 from the $O_2$ sensor 4, as representing a modeling error of the object system model with respect to the actual object system E (hereinafter the difference id/e will be referred to as an "identified error id/e"), according to the following equation (6):

$$id/e(k)=VO2(k)-V\hat{O}2(k) \tag{6}$$

The identifier 11 further determines new identified gain coefficients a1(k) hat, a2(k) hat, b1(k) hat, stated otherwise, a new vector Θ(k) having these identified gain coefficients as elements (hereinafter the new vector Θ(k) will be referred to as an "identified gain coefficient vector Θ"), in order to minimize the identified error id/e, according to the equation (7) given below. That is, the identifier 11 varies the identified gain coefficients a1 hat (k−1), a2 hat (k−1), b1 hat (k−1) determined in the preceding control cycle by a quantity proportional to the identified error id/e for thereby determining the new identified gain coefficients a1(k) hat, a2(k) hat, b1(k) hat.

$$\Theta(k)=\Theta(k-1)+K\theta(k)\cdot id/e(k) \tag{7}$$

where Kθ represents a cubic vector determined by the following equation (8), i.e., a gain coefficient vector for determining a change depending on the identified error id/e of the identified gain coefficients a1 hat, a2 hat, b1 hat):

$$K\theta(k)=\frac{P(k-1)\xi(k)}{1+\xi^T(k)P(k-1)\xi(k)} \tag{8}$$

where P represents a cubic square matrix determined by a recursive formula expressed by the following equation (9):

$$P(k)=\frac{1}{\lambda_1 k}\left[I-\frac{\lambda_2(k)P(k-1)\xi(k)\xi^T(k)}{\lambda_1(k)+\lambda_2(k)\xi^T(k)P(k-1)\xi(k)}\right]P(k-1) \tag{9}$$

where I represents a unit matrix.

In the equation (9), $\lambda_1$, $\lambda_2$ are established to satisfy the conditions $0<\lambda_1\leqq 1$ and $0\leqq\lambda_2<2$, and an initial value P(0) of P represents a diagonal matrix whose diagonal components are positive numbers.

Depending on how $\lambda_1$, $\lambda_2$ in the equation (9) are established, any one of various specific algorithms including a fixed gain method, a degressive gain method, a method of weighted least squares, a method of least squares, a fixed tracing method, etc. may be employed. According to present embodiment, a method of least squares ($\lambda_1=\lambda_2=1$), for example, is employed.

Basically, the identifier 11 sequentially determines in each control cycle the identified gain coefficients a1 hat, a2 hat, b1 hat of the object system model in order to minimize the identified error id/e according to the above algorithm (specifically, a sequential method of least squares). Through this operation, it is possible to sequentially obtain the identified gain coefficients a1 hat, a2 hat, b1 hat which match the actual object system E.

The calculating operation described above is the basic processing that is carried out by the identifier 11. In present embodiment, the identifier 11 performs additional processes such as a limiting process, on the identified gain coefficients a1 hat, a2 hat, b1 hat in order to determine them. Such operations of the identifier 11 will be described later on.

The estimator 12 sequentially determines in each control cycle the estimated differential output VO2 bar which is an estimated value of the differential output VO2 from the $O_2$ sensor 4 after the dead time d in order to compensate for the effect of the dead time d of the object system E for the calculation of the target differential air-fuel ratio kcmd with the sliding mode controller 13 as described in detail later on. The algorithm of an estimating process carried out by the estimator 12 is constructed as follows:

Using the equation (1) representative of the object system model, the estimated differential output VO2(k+d) bar which is an estimated value of the differential output VO2(k+d) of the $O_2$ sensor 4 after the dead time d in each control cycle is expressed using time-series data VO2(k), VO2(k−1) prior to the present time of the differential output VO2 of the $O_2$ sensor 4 calculated by the subtractor 10*a,* and past time-series data kcmd(k−j) (j=1, 2, . . . , d) of the target differential air-fuel ratio kcmd calculated by the subtractor 10*b,* according to the following equation (10):

$$\overline{VO2}(k+d)=\alpha 1\cdot VO2(k)+\alpha 2\cdot VO2(k-1)+\sum_{j=1}^{d}\beta_j\cdot kcmd(k-j) \tag{10}$$

where

α1=the first-row, first-column element of $A^d$,

α2=the first-row, second-column element of $A^d$,

βj=the first-row elements of $A^{j-1}\cdot B$ $$A=\begin{bmatrix} a1 & a2 \\ 1 & 0 \end{bmatrix}$$

$$B=\begin{bmatrix} b1 \\ 0 \end{bmatrix}$$

In the equation (10), α1, α2 represent the first-row, first-column element and the first-row, second-column element of the dth power $A^d$ (d: dead time) of the matrix A defined as described above, and βj represents the first-row elements of the product $A^{j-1}\cdot B$ of the (j−1)th power $A^{j-1}$ (j=1, 2, . . . , d) of the matrix A and the vector B defined as described above.

The above equation (10) is a basic equation for the estimator 12 to calculate the estimated differential output VO2(k+d) bar in this embodiment. Stated otherwise, the estimator 12 determines the estimated differential output VO2 bar of the $O_2$ sensor 4 according to the equation (10) in each control cycle, using the time-series data VO2(k), VO2(k−1) prior to the present time of the differential output VO2 of the $O_2$ sensor 4 calculated by the subtractor 10*a,* and the past data kcmd(k−j) (j=1, . . . , d) of the target differential air-fuel ratio kcmd calculated by the subtractor 10*b.*

The values of the coefficients $\alpha 1$, $\alpha 2$, $\beta j$ (j=1, 2, . . . , d) required to calculate the estimated differential output VO2 (k+d) bar according to the equation (10) are basically calculated using the identified gain coefficients a1 hat, a2 hat, b1 hat which are identified values of the gain coefficients a1, a2, b1 (these are elements of the matrix A and the vector B defined above with respect to the equation (10)). For the value of the dead time d required for the calculation of the equation (10), the preset values described above are used.

The above calculating process is the basic algorithm for the estimator 12 to determine the estimated differential output VO2(k+d) bar which is an estimated value after the dead time d of the differential output VO2 of the $O_2$ sensor 4 in each control cycle.

The sliding mode controller 13 will be described in detail below.

The sliding mode controller 13 sequentially determines the target differential air-fuel ratio kcmd as an input quantity to be given to the object system E in order to converge the output signal VO2/OUT from the $O_2$ sensor 4 to the target value VO2/TARGET, i.e., to converge the differential output VO2 of the $O_2$ sensor 4 to "0", according to an adaptive sliding mode control process which incorporates an adaptive control law for minimizing the effect of a disturbance, in the normal sliding mode control process. An algorithm for carrying out the adaptive sliding mode control process is constructed as follows:

As described in greater detail later on, according to the present embodiment, the target differential air-fuel ratio kcmd generated by the sliding mode controller 13 is basically in agreement with the target differential air-fuel ratio kcmd which the subtractor **10*b* calculates from the target air-fuel ratio KCMD, but may not be in agreement therewith. For this reason, the target differential air-fuel ratio kcmd generated by the sliding mode controller 13** will be referred to as a "demand differential air-fuel ratio usl".

A switching function required for the adaptive sliding mode control process of the sliding mode controller 13 and a hyperplane defined by the switching function (also referred to as a slip plane) will first be described below.

According to a basic concept of the sliding mode control process in the present embodiment, the differential output VO2(k) from the $O_2$ sensor 4 calculated by the subtractor **10*a* in each control cycle and the differential output VO2 (k−1) calculated in each preceding control cycle are used as a state quantity to be controlled (so-called a controlled variable), and a switching function $\sigma$ for the sliding mode control process is established according to the following equation (11). The switching function $\sigma$ is defined by a linear function having as components the time-series data VO2(k), VO2(k−1) prior to the present time of the differential output VO2 of the $O_2$ sensor 4**. The vector X defined according to the equation (11) as a vector having the differential outputs VO2(k), VO2(k−1) as its components will hereinafter be referred to as a state quantity X.

$$\begin{aligned}\sigma(k) &= s1 \cdot VO2(k) + s2 \cdot VO2(k-1) \\ &= S \cdot X\end{aligned} \tag{11}$$

$$\left(S = [s1 \quad s2],\ X = \begin{bmatrix} VO2(k) \\ VO2(k-1) \end{bmatrix}\right)$$

The coefficients s1, s2 relative to the components VO2(k), VO2(k−1) of the switching function $\sigma$ are established to meet the condition of the equation (12) given below. The condition is to be met by the coefficients s1, s2 for the differential output VO2 of the $O_2$ sensor to converge stably to "0" with the value of the switching function $\sigma$ being "0".

$$-1 < \frac{s2}{s1} < 1 \tag{12}$$

$$(\text{when } s1 = 1,\ -1 < s2 < 1)$$

In the present embodiment, for the sake of brevity, the coefficient s1 is set to s1=1 (s2/s1=s2), and the coefficient s2 is established to satisfy the condition: −1<s2<1.

With the switching function $\sigma$ thus defined, the hyperplane for the sliding mode control process is defined by the equation $\sigma$=0. Since the state quantity X is of the second degree, the hyperplane $\sigma$=0 is represented by a straight line as shown in FIG. 3, and, at this time, the hyperplane is also called a switching function.

The time-series data of the estimated differential output VO2 bar determined by the estimator 12 is actually used as the components of the switching function, as described later on.

Figure 3:
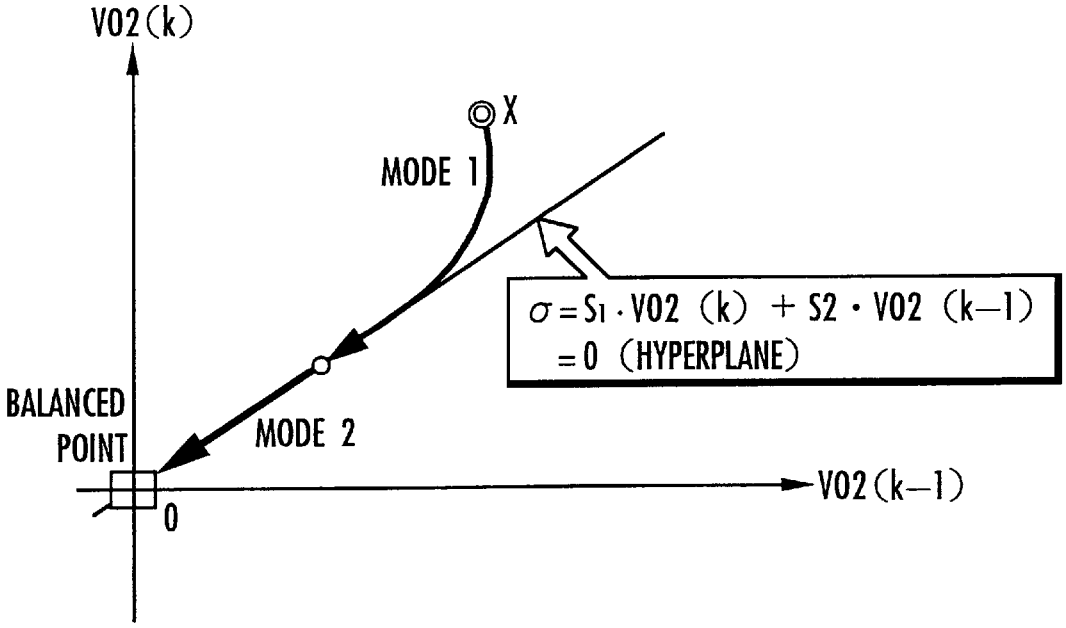
FIG. 3 is a diagram illustrative of a sliding mode control process employed by the air-fuel ratio control system shown in FIG. 1.

The adaptive sliding mode control process in this embodiment serves to converge the state quantity X onto the hyperplane $\sigma$=0 according to a reaching control law which is a control law for converging the state quantity X=(VO2 (k), VO2(k−1)) onto the hyperplane $\sigma$=0, i.e., for converging the value of the switching function $\sigma$ to "0", and an adaptive control law (adaptive algorithm) which is a control law for compensating for the effect of a disturbance in converging the state quantity X onto the hyperplane $\sigma$=0 (mode 1 in FIG. 3). While converging the state quantity X onto the hyperplane $\sigma$=0 according to an equivalent control input (holding the value of the switching function $\sigma$ at "0"), the state quantity X is converged to a balanced point on the hyperplane $\sigma$=0 where VO2(k)=VO2(k−1)=0, i.e., a point where time-series data VO2/OUT(k), VO2/OUT(k−1) of the output VO2/OUT of the $O_2$ sensor 4 are equal to the target value VO2/TARGET (mode 2 in FIG. 3).

In the ordinary sliding mode control process, the adaptive control law is omitted in the mode 1, and the state quantity X is converged onto hyperplane $\sigma$=0 according to the reaching control law only.

The demand differential air-fuel ratio usl to be generated by the sliding mode controller 13 for converging the state quantity X to the balanced point on the hyperplane $\sigma$=0 is expressed as the sum of an equivalent control law input ueq to be applied to the object system E according to the control law for converging the state quantity X onto the hyperplane $\sigma$=0, a component urch (hereinafter referred to as a "reaching control law input urch") of an input quantity to be applied to the object system E according to the reaching control law, and a component uadp (hereinafter referred to as an "adaptive control law input uadp") of the input quantity to be applied to the object system E according to the adaptive control law (see the following equation (13)).

$$Usl = Ueq + Urch + Uadp \tag{13}$$

The equivalent control law input ueq, the reaching control law input urch, and the adaptive control law uadp are determined on the basis of the object system model expressed by the equation (1), as follows:

The equivalent control law input ueq which is a component of the input quantity to be applied to the object system E for converging the state quantity X onto the hyperplane $\sigma$=0 (holding the value of the switching function $\sigma$ at "0") is equal to the target differential air-fuel ratio kcmd which satisfies the condition: σ(k+1)=σ(k)=0. Using ing the equations (1), (11), the equivalent control law input ueq which satisfies the above condition is given by the following equation (14):

$$Ueq(k) = -(S \cdot B)^{-1} \cdot \{S \cdot (A-1)\} \cdot X(k+d) \tag{14}$$
$$= \frac{-1}{s1b1} \cdot \{[s1 \cdot (a1-1) + s2] \cdot VO2(k+d) + (s1 \cdot a2 - s2) \cdot VO2(k+d-1)\}$$

The equation (14) is a basic formula for determining the equivalent control law input ueq(k) in each control cycle.

According to present embodiment, the reaching control law input urch is basically determined according to the following equation (15):

$$Urch(k) = -(S \cdot B)^{-1} \cdot F \cdot \sigma(k+d) \tag{15}$$
$$= \frac{-1}{s1b1} \cdot F \cdot \sigma(k+d)$$

Specifically, the reaching control law input urch is determined in proportion to the value σ(k+d) of the switching function σ after the dead time d, in view of the effect of the dead time d of the object system E.

The coefficient F in the equation (15) which determines the gain of the reaching control law is established to satisfy the condition expressed by the following equation (16):

$$0<F<2 \tag{16}$$

The value of the switching function σ may possibly vary in an oscillating fashion (so-called chattering) with respect to "0". In order to suppress such chattering, it is preferable that the coefficient F relative to the reaching control law input urch be established to further satisfy the condition of the following equation (17):

$$0<F<1 \tag{17}$$

The adaptive control law input uadp is basically determined according to the following equation (18) (ΔT in the equation (18) represents the period (constant) of the control cycles of the air-fuel ratio processing controller 5*a*):

$$Uadp(k) = -(S \cdot B)^{-1} \cdot G \cdot \sum_{i=0}^{k+d} (\sigma(i) \cdot \Delta T) \tag{18}$$
$$= \frac{-1}{s1b1} \cdot G \cdot \sum_{i=0}^{k+d} (\sigma(i) \cdot \Delta T)$$

The adaptive control law input uadp is determined in proportion to an integrated value (which corresponds to an integral of the values of the switching function σ) over control cycles of values of the switching function σ until after the dead time d, in view of the effect of the dead time d of the object system E.

The coefficient G (which determines the gain of the adaptive control law) in the equation (18) is established to satisfy the condition of the following equation (19):

$$G = J \cdot \frac{2-F}{\Delta T} \tag{19}$$
$$(0 < J < 2)$$

A specific process of deriving conditions for establishing the equations (16), (17), (19) is described in detail in Japanese laid-open patent publication No. 11-93741, and will not be described in detail below.

The demand differential air-fuel ratio usl as an input quantity to be given to the object system E for converging the output signal VO2/OUT of the $O_2$ sensor 4 to its target value VO2/TARGET, i.e., for converging the differential output VO2 of the $O_2$ sensor 4 to "0", may basically be determined as the sum (ueq+urch+uadp) of the equivalent control law input ueq, the reaching control law input urch, and the adaptive control law uadp determined according to the respective equations (14), (15), (18). However, the differential outputs VO2(k+d), VO2(k+d−1) of the $O_2$ sensor 4 and the value σ(k+d) of the switching function σ, etc. used in the equations (14), (15), (18) cannot directly be obtained as they are values in the future.

According to present embodiment, therefore, the sliding mode controller 13 uses the estimated differential outputs VO2(k+d) bar, VO2(k+d−1) bar determined by the estimator 12, instead of the differential outputs VO2(k+d), VO2(k+d−1) from the $O_2$ sensor 4 for determining the equivalent control law input ueq according to the equation (14), and calculates the equivalent control law input ueq in each control cycle according to the following equation (20):

$$Ueq(k) = \frac{-1}{s1b1} \{[s1 \cdot (a1-1) + s2] \cdot \overline{VO2}(k+d) + (s1 \cdot a2 - s2) \cdot \overline{VO2}(k+d-1)\} \tag{20}$$

According to the present embodiment, furthermore, the sliding mode controller 13 actually uses time-series data of the estimated differential output VO2 bar sequentially determined by the estimator 12 as described as a state quantity to be controlled. That is, the sliding mode controller 13 defines a switching function a bar according to the following equation (21) (the switching function σ bar corresponds to time-series data of the differential output VO2 in the equation (11) which is replaced with time-series data of the estimated differential output VO2 bar), in place of the switching function σ established according to the equation (11):

$$\overline{\sigma(k)} = s1 \cdot \overline{VO2}(k) + s2 \cdot \overline{VO2}(k-1) \tag{21}$$

The sliding mode controller 13 calculates the reaching control law input urch in each control cycle according to the following equation (22), using the value of the switching function a bar represented by the equation (21), rather than the value of the switching function σ for determining the reaching control law input urch according to equation (15):

$$Urch(k) = \frac{-1}{s1b1} \cdot F \cdot \overline{\sigma}(k+d) \tag{22}$$

Similarly, the sliding mode controller 13 calculates the adaptive control law input uadp in each control cycle according to the following equation (23), using the value of the switching function a bar represented by the equation (21), rather than the value of the switching function σ for determining the adaptive control law input uadp according to the equation (18):

$$Uadp(k) = \frac{-1}{s1b1} \cdot G \cdot \sum_{i=0}^{k+d} (\bar{\sigma}(i) \cdot \Delta T) \tag{23}$$

The latest identified gain coefficients a1(k) hat, a2(k) hat, b1(k) hat which have been determined by the identifier 11 are basically used as the gain coefficients a1, a1, b1 that are required to calculate the equivalent control law input ueq, the reaching control law input urch, and the adaptive control law input uadp according to the equations (20), (22), (23).

The sliding mode controller 13 determines the sum of the equivalent control law input ueq, the reaching control law input urch, and the adaptive control law input uadp determined according to the equations (20), (22), (23), as the demand differential air-fuel ratio usl (see the equation (13)). The conditions for establishing the coefficients s1, s2, F, G used in the equations (20), (22), (23) are as described above.

The demand differential air-fuel ratio usl determined by the sliding mode controller 13 as described above signifies an input quantity to be given to the object system E for converging the estimated differential output VO2 bar from the $O_2$ sensor 4 to "0", and as a result, for converging the output VO2/OUT from the $O_2$ sensor 4 to the target value VO2/TARGET.

The above process is a calculating process (algorithm) for generating the demand differential air-fuel ratio usl (which is basically in agreement with the target differential air-fuel ratio kcmd (=KCMD−FLAF/BASE)) in each control cycle by the sliding mode controller 13.

As described above, the demand differential air-fuel ratio usl generated by the sliding mode controller 13 represents the difference of the air-fuel ratio of the internal combustion engine 1 required to converge the output VO2/OUT from the $O_2$ sensor 4 to the target value VO2/TARGET, from the air-fuel ratio reference value FLAF/BASE. The adder 14 of the air-fuel ratio processing controller 5*a* basically adds the air-fuel ratio reference value FLAF/BASE to the demand differential air-fuel ratio usl generated by the sliding mode controller 13 for finally determining the target air-fuel ratio KCMD, which is then given to the fuel processing controller 5*b,* according to the following equation (24):

$$KCMD(k)=usl(k)+FLAF/BASE \tag{24}$$

In this embodiment, in order to prevent the air-fuel ratio of the internal combustion engine 1 from varying excessively and also keep the internal combustion engine 1 operating stably, the demand differential air-fuel ratio usl (=ueq+urch+uadp) determined from the equivalent control law input ueq, the reaching control law input urch, and the adaptive control law input uadp by the sliding mode controller 13 according to the equation (13) is limited to a value within a predetermined allowable range, and then the adder 14 generates the target air-fuel ratio KCMD (an element for carrying out the limiting process is omitted from illustration in FIG. 1). More specifically, in the above limiting process, if the demand differential air-fuel ratio usl determined by the sliding mode controller 13 according to the equation (13) is greater than the upper limit value or lower limit value of the allowable range, then the demand differential air-fuel ratio usl is forcibly limited to the upper limit value or lower limit value of the allowable range. Then, the adder 14 adds the limited demand differential air-fuel ratio usl to the air-fuel ratio reference value FLAF/BASE for thereby finally determining the target air-fuel ratio KCMD to be given to the fuel processing controller 5*b*. When the demand differential air-fuel ratio usl is forcibly limited to the upper limit value or lower limit value of the allowable range, the target differential air-fuel ratio kcmd (=KCMD−FLAF/BASE) calculated by the subtractor 10*b* and the demand differential air-fuel ratio usl (=ueq+urch+uadp) determined by the sliding mode controller 13 according to the equation (13) do not agree with each other.

The demand differential air-fuel ratio usl determined by the sliding mode controller 13 according to the equation (13) is usually of a value within the above allowable able range. At this time, the target air-fuel ratio KCMD is calculated using the demand differential air-fuel ratio usl as it is according to the equation (24). Therefore, the target differential air-fuel ratio kcmd (=KCMD−FLAF/BASE) calculated by the subtractor 10*b* and the demand differential air-fuel ratio usl (=ueq+urch+uadp) determined by the sliding mode controller 13 according to the equation (13) agree with each other.

In this embodiment, the stability of the controlled state of the output VO2/OUT of the $O_2$ sensor 4 according to the adaptive sliding mode control process carried out by the sliding mode controller 13 is determined, and the value of the demand differential air-fuel ratio usl is forcibly limited depending on the determined stability. Such a limiting process will be described later on.

Overall operation of the air-fuel ratio control system will be described below.

Figure 4:
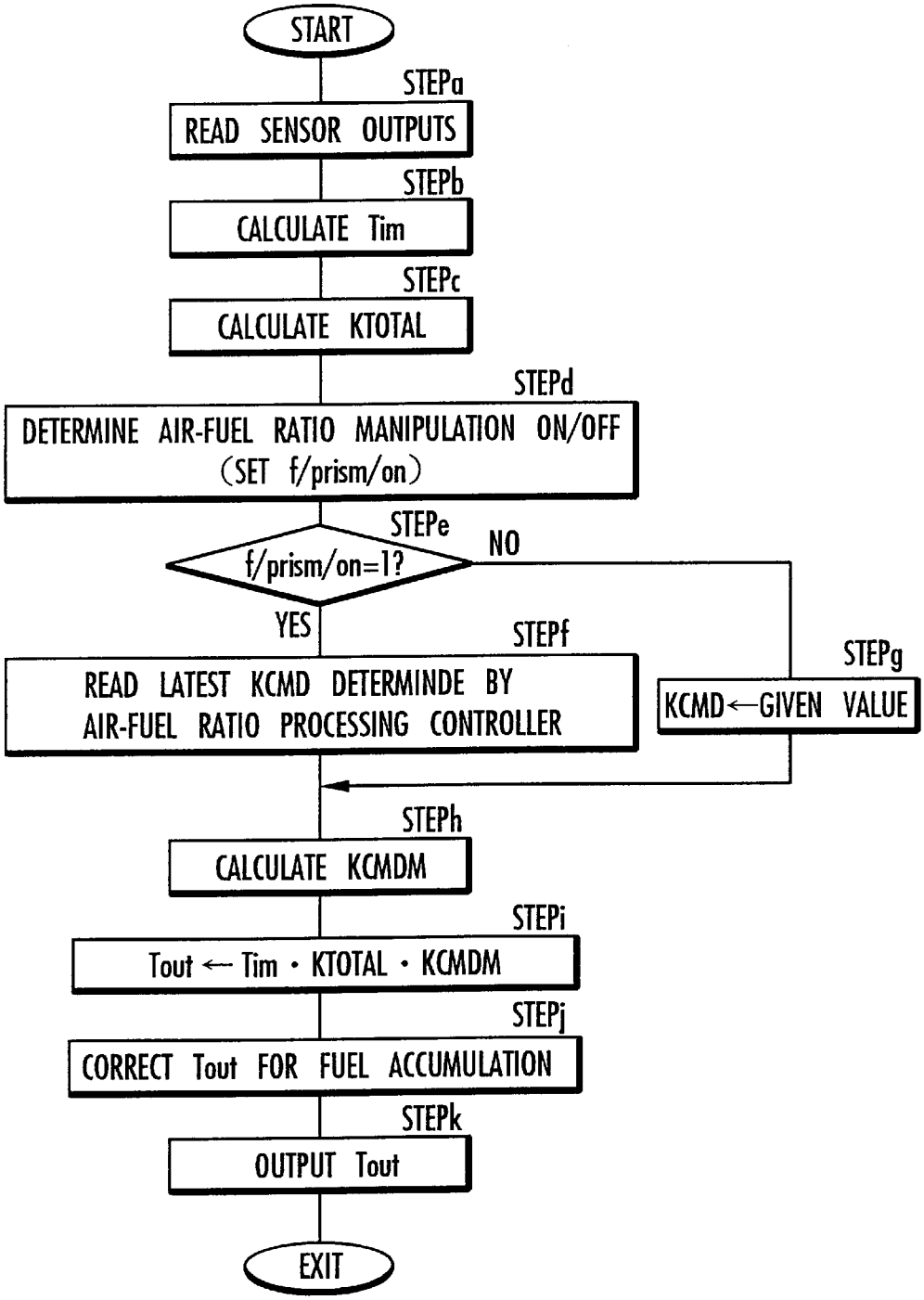
FIG. 4 is a flowchart of a fuel control process for the internal combustion engine, carried out by the air-fuel ratio control system shown in FIG. 1.

First, a process, carried out by the fuel processing controller 5*b,* of determining a fuel injection quantity for the internal combustion engine 1 will be described below with reference to FIG. 4. The fuel processing controller 5*b* carries out the process on control cycles in synchronism with a crankshaft angle period (TDC) of the internal combustion engine 1 as follows:

In FIG. 4, the fuel processing controller 5*b* reads outputs (detected data required to determine a fuel injection quantity for the internal combustion engine 1) from various sensor s including the non-illustrated sensors for detecting the rotational speed NE and the intake pressure PB of the internal combustion engine 1 and the $O_2$ sensor 4 in STEPa. At this time, the output VO2/OUT of the $O_2$ sensor 4 required for the processing operation of the air-fuel ratio processing controller 5*a* is given via the fuel processing controller 5*b* to the air-fuel ratio processing controller 5*a*. The read data of the output VO2/OUT of the $O_2$ sensor 4, including data obtained in the past, is stored in a time-series fashion in a memory (not shown).

Then, the basic fuel injection quantity calculator 6 corrects a fuel injection quantity corresponding to the rotational speed NE and intake pressure PB of the internal combustion engine 1 depending on the effective opening area of the throttle valve, thereby calculating a basic fuel injection quantity Tim in STEPb. The first correction coefficient calculator 7 calculates a first correction coefficient KTOTAL depending on the coolant temperature and the amount by which the canister is purged in STEPc.

Thereafter, the fuel processing controller 5*b* determines whether the target air-fuel ratio KCMD generated by the air-fuel ratio processing controller 5*a* is to be used to manipulate the air-fuel ratio of the internal combustion engine 1 (air-fuel ratio manipulation ON/OFF), and sets a value of a flag f/prism/on which represents air-fuel ratio manipulation ON/OFF in STEPd. When the value of the flag f/prism/on is "0", it means that the target air-fuel ratio KCMD generated by the air-fuel ratio processing controller 5*a* is not to be used (OFF). When the value of the flag f/prism/on is "1", it means that the target air-fuel ratio KCMD generated by the air-fuel ratio processing controller 5*a* is to be used (ON).

Figure 5:
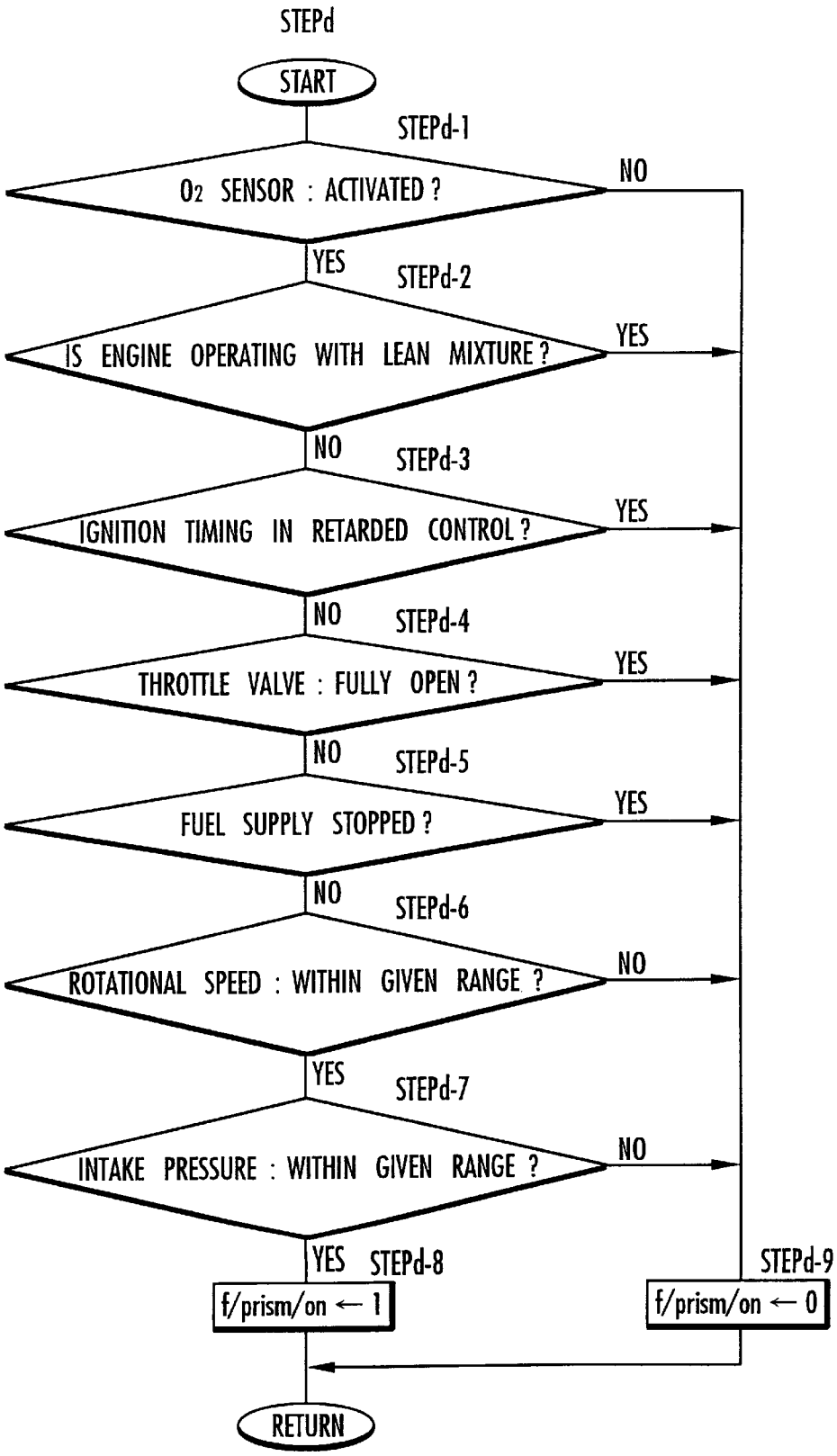
FIG. 5 is a flowchart of a subroutine of the flowchart shown in FIG. 4.

The deciding subroutine of STEPd is shown in detail in FIG. 5. As shown in FIG. 5, the fuel processing controller 5*b* decides whether the $O_2$ sensor 4 is activated or not in STEPd-1. If the $O_2$ sensor 4 is not activated, since detected data from the $O_2$ sensor 4 for use in the processing operation of the air-fuel ratio processing controller 5*a* is not obtained accurately, the value of the flag f/prism/on is set to "0" in STEPd-9.

Then, the fuel processing controller 5*b* decides whether the internal combustion engine 1 is operating with a lean air-fuel mixture or not in STEPd-2. The fuel processing controller 5*b* decides whether the ignition timing of the internal combustion engine 1 is retarded for early activation of the catalytic converter 3 immediately after the start of the internal combustion engine 1 or not in STEPd-3. The fuel processing controller 5*b* decides whether the throttle valve of the internal combustion engine 1 is fully open or not in STEPd-4. The fuel processing controller 5*b* decides whether the supply of fuel to the internal combustion engine 1 is being stopped or not in STEPd-5. If either one of the conditions of these steps is satisfied, then since it is not preferable or possible to manipulate the air-fuel ratio of the internal combustion engine 1 using the target air-fuel ratio KCMD generated by the air-fuel ratio processing controller 5*a,* the value of the flag f/prism/on is set to "0" in STEPd-9.

The fuel processing controller 5*b* then decides whether the rotational speed NE and the intake pressure PB of the internal combustion engine 1 fall within respective given ranges (normal ranges) or not respectively in STEPd-6, STEPd-7. If either one of the rotational speed NE and the intake pressure PB does not fall within its given range, then since it is not preferable to control the air-fuel ratio of the internal combustion engine 1 using the target air-fuel ratio KCMD generated by the air-fuel ratio processing controller 5*a,* the value of the flag f/prism/on is set to "0" in STEPd-9.

If the conditions of STEPd-1, STEPd-6, STEPd-7 are satisfied, and the conditions of STEPd-2, STEPd-3, STEPd-4, STEPd-5 are not satisfied (the internal combustion engine 1 is operating normally), then the fuel processing controller 5*b* sets the value of the flag f/prism/on to "1" in order to use the target air-fuel ratio KCMD generated by the air-fuel ratio processing controller 5*a* for manipulating the air-fuel ratio of the internal combustion engine 1 in STEPd-8.

In FIG. 4, after the value of the flag f/prism/on has been set, the fuel processing controller 5*b* determines the value of the flag f/prism/on in STEPe. If f/prism/on=1, then the fuel processing controller 5*b* reads the latest target air-fuel ratio KCMD generated by the air-fuel ratio processing controller 5*a* in STEPf. If f/prism/on=0, then the fuel processing controller 5*b* sets the target air-fuel ratio KCMD to a predetermined value in STEPg. The predetermined value to be established as the target air-fuel ratio KCMD is determined from the rotational speed NE and intake pressure PB of the internal combustion engine 1 using a predetermined map, for example.

The second correction coefficient calculator 8 calculates in STEPj a second correction coefficient KCMDM for manipulating the air-fuel ratio of the internal combustion engine 1 into the target air-fuel ratio KCMD determined in STEPf or STEPg.

Then, the fuel processing controller 5*b* multiplies the basic fuel injection quantity Tim, determined in STEPa, by the first correction coefficient KTOTAL and the second correction coefficient KCMDM determined respectively in STEPc and STEPh, determining an output fuel injection quantity Tout to be supplied to the internal combustion engine 1 in STEPi. The output fuel injection quantity Tout is then corrected in view of accumulated fuel particles on intake pipe walls of the internal combustion engine 1 by the fuel accumulation corrector 9 in STEPj. The corrected output fuel injection quantity Tout is applied to the non-illustrated fuel injectors of the internal combustion engine 1 in STEPk.

In the internal combustion engine 1, the fuel injectors inject fuel according to the supplied output fuel injection quantity Tout.

The above calculation of the output fuel injection quantity Tout and the fuel injection of the internal combustion engine 1 based on the calculated output fuel injection quantity Tout are carried out in successive cycles synchronous with the crankshaft angle period (TDC) of the internal combustion engine 1 for controlling the air-fuel ratio of the internal combustion engine 1 at the target air-fuel ratio KCMD according to a feed-forward control process.

Figure 6:
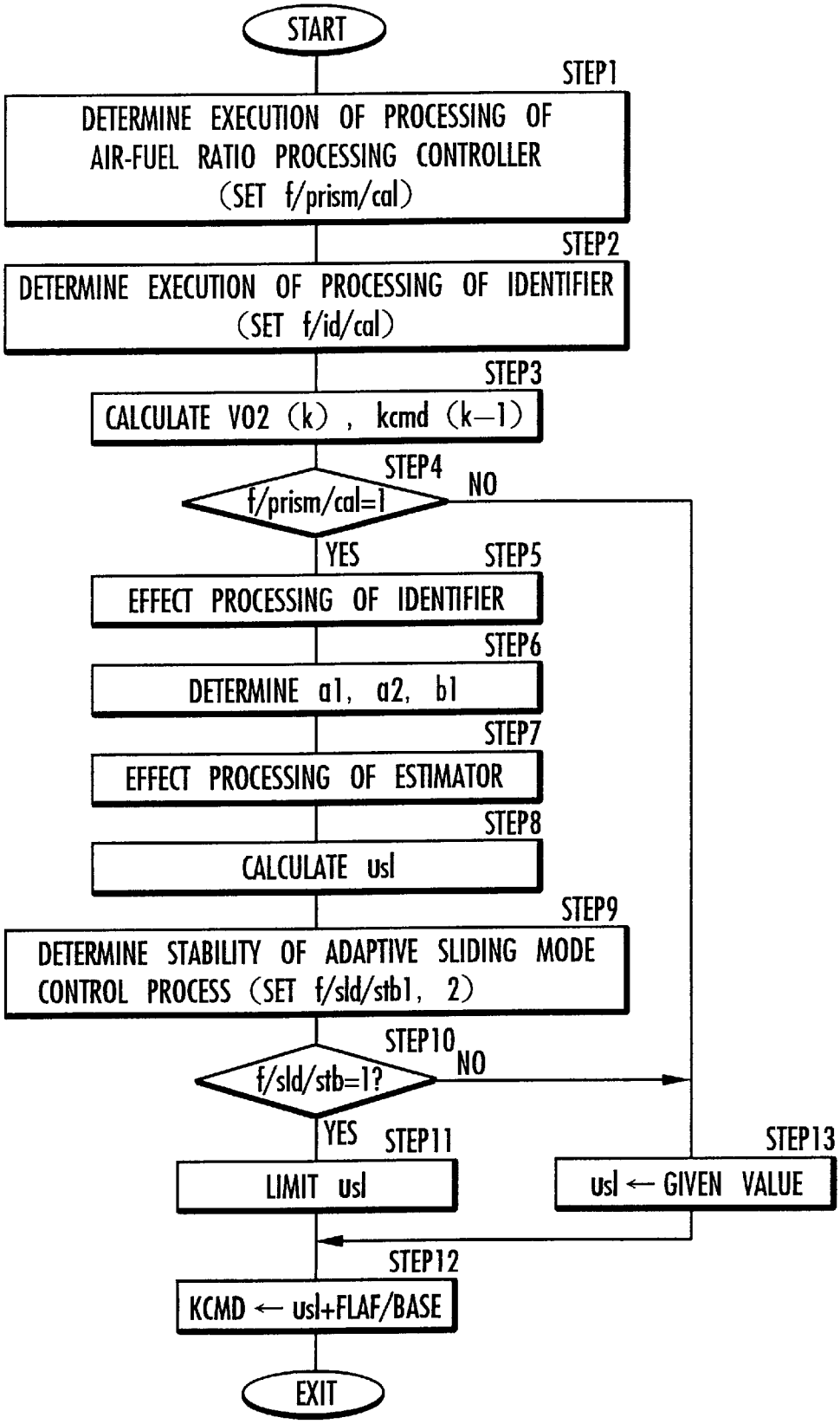
FIG. 6 is a flowchart of a main routine of a process for generating a target air-fuel ratio, carried out by the air-fuel ratio control system shown in FIG. 1.

Concurrent with the above air-fuel ratio manipulation for the internal combustion engine 1 (the adjustment and control of the fuel injection quantity), the air-fuel ratio processing controller 5*a* executes a main routine shown in FIG. 6 in control cycles of a constant period.

Figure 8:
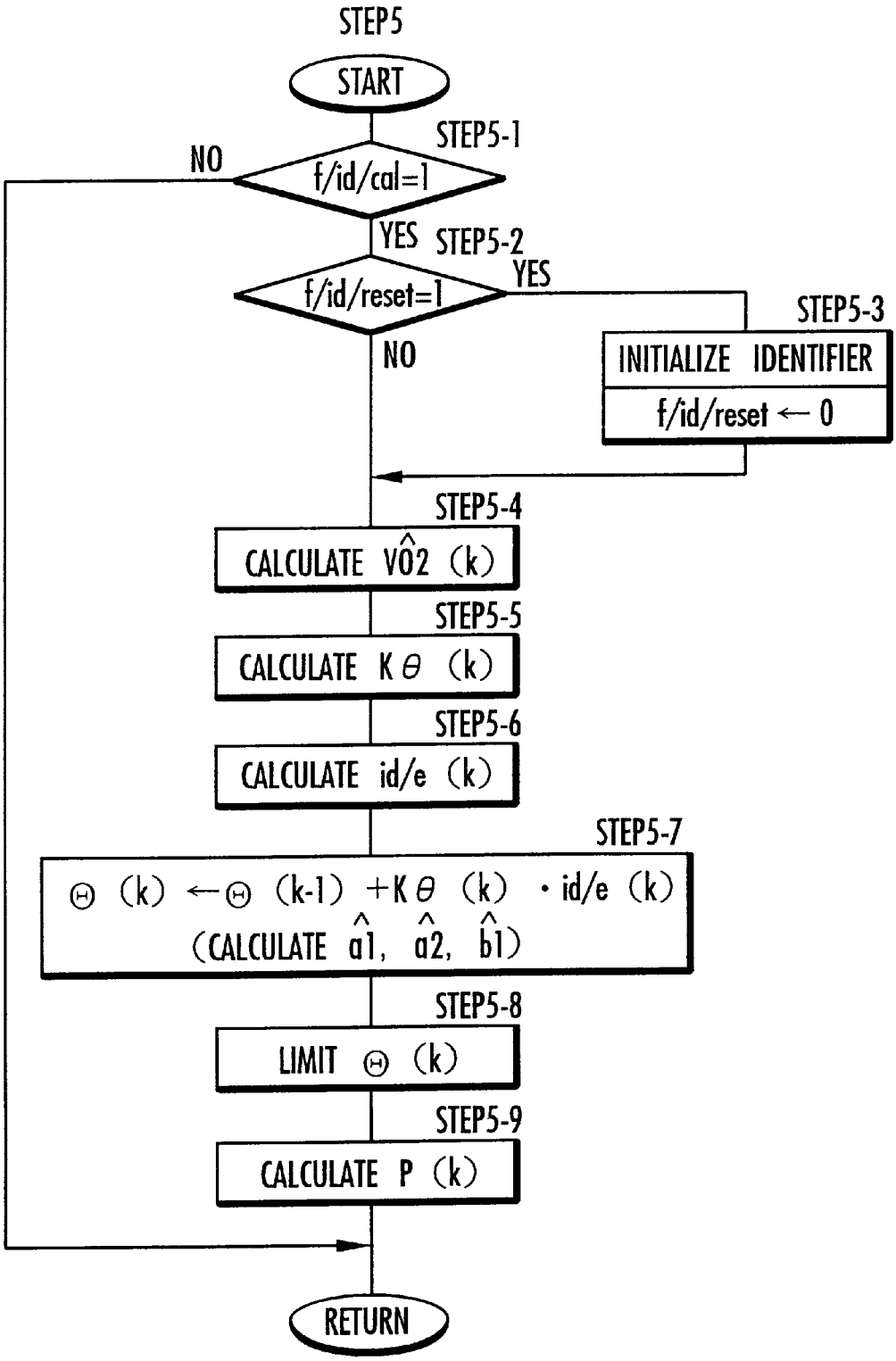
FIG. 8 is a flowchart of a subroutine of the flowchart shown in FIG. 6.

As shown in FIG. 8, the air-fuel ratio processing controller 5*a* decides whether its own processing (the processing of the identifier 11, the estimator 12, and the sliding mode controller 13) is to be executed or not, and sets a value of a flag f/prism/cal indicative of whether the processing is to be executed or not in STEP1. When the value of the flag f/prism/cal is "0", it means that the processing of the air-fuel ratio processing controller 5*a* is not to be executed, and when the value of the flag f/prism/cal is "1", it means that the processing of the air-fuel ratio processing controller 5*a* is to be executed.

Figure 7:
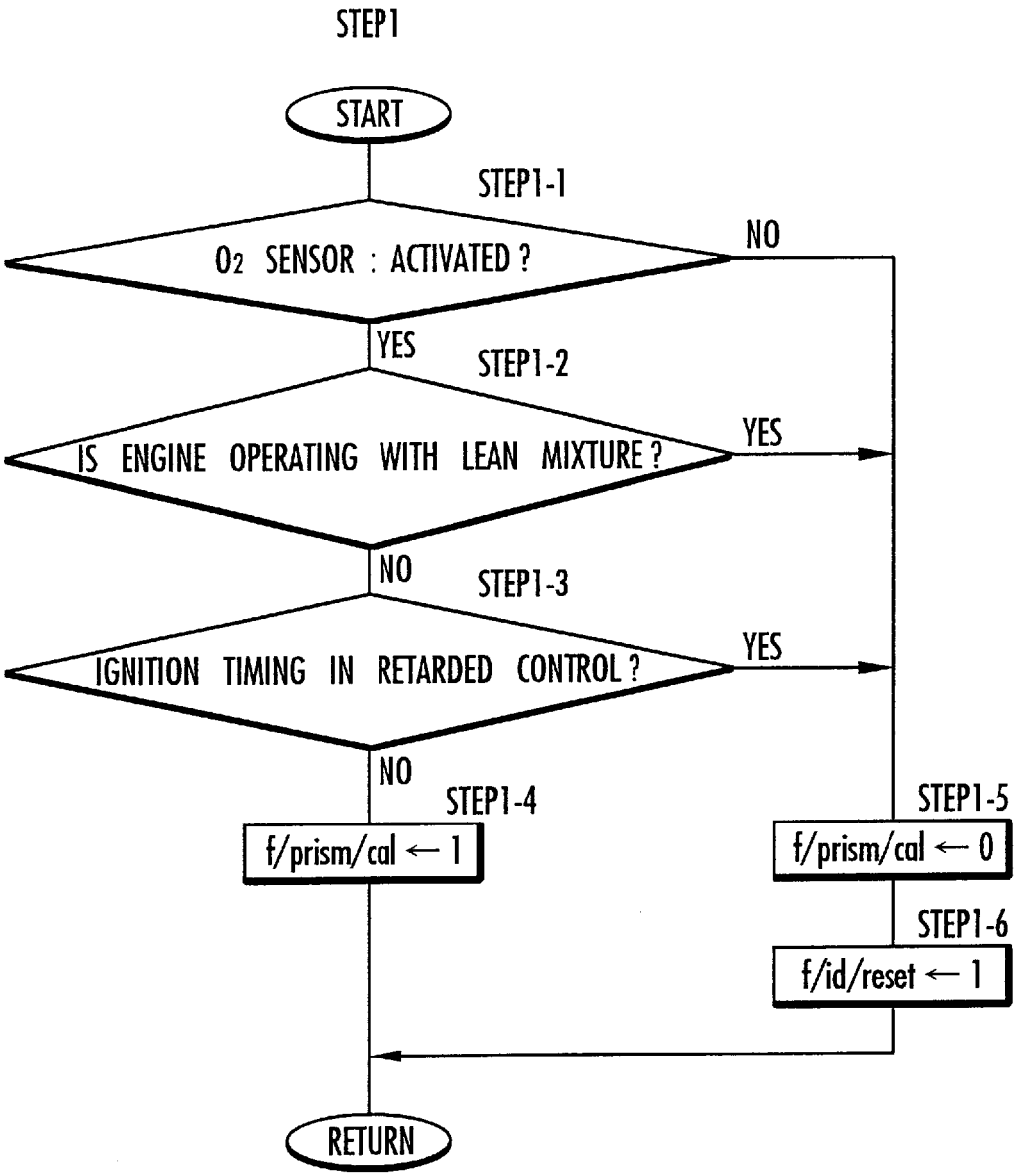
FIG. 7 is a flowchart of a subroutine of the flowchart shown in FIG. 6.
Figure 9:
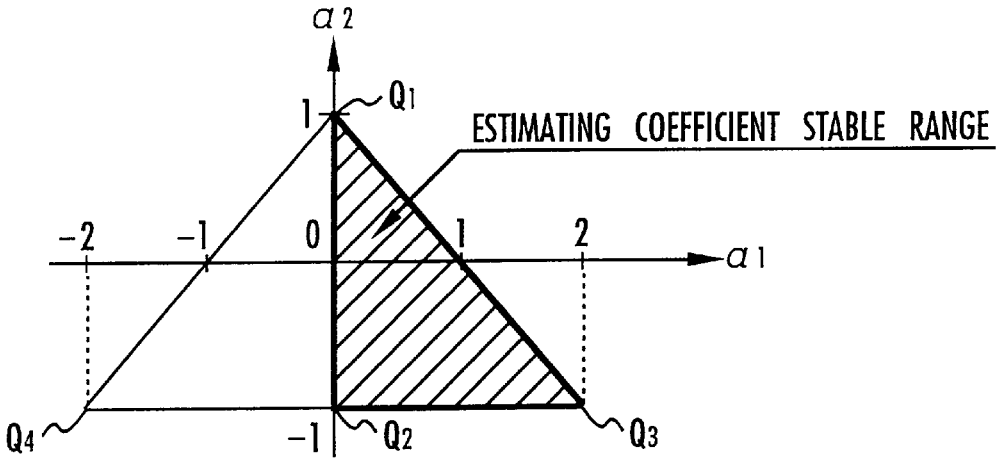
FIG. 9 is a diagram illustrative of partial processing of the flowchart shown in FIG. 8.

The deciding subroutine in STEP1 is shown in detail in FIG. 7. As shown in FIG. 7, the The deciding sub-routine in STEP1 is shown in detail in FIG. 9. As shown in FIG. 9, the air-fuel ratio processing controller 5*a* decides whether the $O_2$ sensor 4 is activated or not in STEP1-1. If the $O_2$ sensor 4 is not activated, since detected data from the $O_2$ sensor 4 for use in the processing operation of the air-fuel ratio processing controller 5*a* is not obtained accurately, the value of the flag f/prism/cal is set to "0" in STEP1-5. Then, in order to initialize the identifier 11 as described later on, the value of a flag f/id/reset indicative of whether the identifier 11 is to be initialized or not is set to "1" in STEP1-6.

The air-fuel ratio processing controller 5*a* decides whether the internal combustion engine 1 is operating with a lean air-fuel mixture or not in STEP1-2. The air-fuel ratio processing controller 5*a* decides whether the ignition timing of the internal combustion engine 1 is retarded for early activation of the catalytic converter 3 immediately after the start of the internal combustion engine 1 or not in STEP1-3. If the conditions of these steps are satisfied, then since the target air-fuel ratio KCMD generated to converge the output VO2/OUT of the $O_2$ sensor 4 to the target value VO2/TARGET is not used for the fuel control for the internal combustion engine 1, the value of the flag f/prism/cal is set to "0" in STEP1-5, and the value of the flag f/id/reset is set to "1" in order to initialize the identifier 11 in STEP1-6.

If the condition of STEP1-1 is satisfied, and the conditions of STEP1-2, STEP1-3 are not satisfied, then the value of the flag f/prism/cal is set to "1" in order to generate the target air-fuel ratio KCMD so as to converge the output VO2/OUT of the $O_2$ sensor 4 to the target value VO2/TARGET, in STEP1-4.

In FIG. 6, after the above deciding subroutine, the air-fuel ratio processing controller 5*a* decides whether a process of identifying (updating) the gain coefficients a1, a1, b1 with the identifier 11 is to be executed or not, and sets a value of a flag f/id/cal indicative of whether the process of identifying (updating) the gain coefficients a1, a1, b1 is to be executed or not in STEP2.

In STEP2, the air-fuel ratio processing controller 5*a* decides whether the throttle valve of the internal combustion engine 1 is substantially fully open or not, and whether the supply of fuel to the internal combustion engine 1 is being stopped or not. If either one of the conditions of these steps is satisfied, then since it is not possible to identify the gain coefficients a1, a2, b1 appropriately, the value of the flag f/id/cal is set to "0". If neither one of the conditions of these steps is satisfied, then the value of the flag f/id/cal is set to "1" to identify (update the gain coefficients a1, a2, b1 with the identifier 11.

The air-fuel ratio processing controller 5*a* calculates the latest differential output VO2(k) (=VO2/OUT−VO2/TARGET) of the $O_2$ sensor 4 with the subtractor 10*a,* and the target differential air-fuel ratio kcmd(k−1) (=KCMD(k−1)−FLAF/BASE) corresponding to the target air-fuel ratio KCMD(k−1) finally determined in the preceding control cycle with the subtractor 10*b,* in STEP3. Specifically, the subtractor 10*a* selects a latest one of the time-series data of the output VO2/OUT of the $O_2$ sensor 4 read and stored in the non-illustrated memory in STEPa shown in FIG. 4, and calculate the differential output VO2(k). The data of the differential output VO2(k) and the target air-fuel ratio KCMD(k−1) calculated by the subtractor 10*b,* as well as the data thereof calculated in the past, are stored in a time-series manner in a memory (not shown) in the air-fuel ratio processing controller 5*a*.

Then, in STEP4, the air-fuel ratio processing controller 5*a* determines the value of the flag f/prism/cal set in STEP1. If the value of the flag f/prism/cal is "0", i.e., if the processing of the air-fuel ratio processing controller 5*a* is not to be executed, then the air-fuel ratio processing controller 5*a* forcibly sets the value of the demand differential air-fuel ratio usl (the demand differential air-fuel ratio usl to be given to the adder 14) for determining the target air-fuel ration KCMD in the present control cycle to a predetermined value in STEP13. The predetermined value may be a fixed value (e.g., "0") or the value of the demand differential air-fuel ratio usl determined in a preceding control cycle.

After the demand differential air-fuel ratio usl is set to the predetermined value in STEP13, the adder 14 adds the air-fuel ratio reference value FLAF/BASE to the demand differential air-fuel ratio usl for thereby determining a target air-fuel ratio KCMD in the present control cycle in STEP12. Then, the processing in the present control cycle is finished.

If the value of the flag f/prism/cal is "1" in STEP4, i.e., if the processing of the air-fuel ratio processing controller 5*a* is to be executed, then the air-fuel ratio processing controller 5*a* effects the processing of the identifier 11 in STEP5.

The processing subroutine of STEP5 is shown in detail in FIG. 8.

The identifier 11 determines the value of the flag f/id/cal set in STEP2, in STEP5-1. If the value of the flag f/id/cal is "0" (the throttle valve of the internal combustion engine 1 is fully open or the fuel supply of the internal combustion engine 1 is being cut off), then since the process of identifying the gain coefficients a1, a2, b1 with the identifier 11 is not carried out, control immediately goes back to the main routine shown in FIG. 6.

If the value of the flag f/id/cal is "1", then the identifier 11 determines the value of the flag f/id/reset set in STEP1 with respect to the initialization of the identifier 11 in STEP5-2. If the value of the flag f/id/reset is "1", the identifier 11 is initialized in STEP5-3. When the identifier 11 is initialized, the identified gain coefficients a1 hat, a2 hat, b1 hat are set to predetermined initial values (the identified gain coefficient vector Θ according to the equation (3) is initialized), and the elements of the matrix P (diagonal matrix) according to the equation (9) are set to predetermined initial values. The value of the flag f/id/reset is reset to "0".

Then, the identifier 11 calculates the identified differential output VO2(k) hat that is an output quantity from the object system model (see the equation (2)) which is expressed using the present identified gain coefficients a1(k−1) hat, a2(k−1) hat, b1(k−1) hat, according to the equation (2) or the equation (5) equivalent thereto, using the past data VO2(k−1), VO2(k−2) of the differential output VO2 calculated in each control cycle in STEP3, the past data kcmd(k−d−1) of the target differential air-fuel ratio kcmd, and the identified gain coefficients a1(k−1) hat, a2(k−1) hat, b1(k−1) hat, in STEP5-4.

The identifier 11 then calculates the vector Kθ(k) to be used in determining the new identified gain coefficients a1 hat, a2 hat, b1 hat according to the equation (8) in STEP5-5. Thereafter, the identifier 11 calculates the identified error id/e, i.e., the difference between the identified differential output VO2 hat from the $O_2$ sensor 4 in the object system model and the actual differential output VO2 (see the equation (6)), in STEP5-6.

The identified error id/e obtained in STEP5-6 may basically be calculated according to the equation (6). In the present embodiment, however, a value (=VO2−VO2 hat) calculated according to the equation (6) from the differential output VO2 acquired in each control cycle in STEP3 (see FIG. 6), and the identified differential output VO2 hat calculated in each control cycle in STEP5-4 is filtered with given frequency passband characteristics to calculate the identified error idle. In this embodiment, the given frequency passband characteristics comprise low-pass characteristics.

The above filtering process is carried out for the following reasons: The frequency characteristics of a change in the output quantity (the output VO2/OUT of the $O_2$ sensor 4) with respect to a change in the input quantity (the target air-fuel ratio KCMD) of the object system E are generally of a high gain at low frequencies because of the catalytic converter 3 included in the object system E. Therefore, in order to appropriately identify the gain coefficients a1, a2, b1 of the object system model according to the actual behavior of the object system E, it is preferable to attach importance to the low-frequency behavior of the object system E. Thus, in this embodiment, the identified error id/e is determined by filtering the value (=VO2−VO2 hat) calculated according to the equation (6) with low-pass characteristics.

The low-pass characteristics for the above filtering process are illustrative only. More generally, the frequency characteristics (which may be affected by not only the catalytic converter 3 but also the characteristics of the internal combustion engine 1) of a change in the output quantity with respect to a change in the input quantity of the object system E may be confirmed beforehand by experimentation or the like, and the value (=VO2−VO2 hat) calculated according to the equation (6) may be filtered with a passband where the confirmed frequency characteristics are of a high gain.

Both the differential output VO2 and the identified differential output VO2 hat may be filtered with the same low-pass characteristics. For example, after the differential output VO2 and the identified differential output VO2 hat have separately been filtered, the equation (6) may be calculated to determine the identified error id/e. The above filtering is carried out by a moving average process which is a digital filtering process, for example.

After the identifier 11 has calculated the identified error id/e, the identifier 11 calculates a new identified gain coefficient vector Θ(k), i.e., new identified gain coefficients a1(k) hat, a2(k) hat, b1(k) hat, according to the equation (7) using the identified error id/e and Kθ calculated in SETP5-5 in STEP5-7.

After having calculated the new identified gain coefficients a1(k) hat, a2(k) hat, b1(k) hat, the identifier 11 further limits the values of the gain coefficients a1 hat, a2 hat, b1 hat (elements of the identified gain coefficient vector Θ), are limited to meet predetermined conditions, as described below, in STEP5-8.

The predetermined conditions for limiting the values of the identified gain coefficients a1 hat, a2 hat, b1 hat include a condition (hereinafter referred to as a "first limiting condition") for limiting combinations of the values of the identified gain coefficients a1 hat, a2 hat relative to a predetermined combination, and a condition (hereinafter referred to as a "second limiting condition") for limiting the value of the identified gain coefficient b1 hat.

Prior to describing the first and second limiting conditions and the specific processing details of STEP5-8, the reasons for limiting the values of the identified gain coefficients a1 hat, a2 hat, b1 hat will be described below.

The inventors of the present invention have found that if the values of the identified gain coefficients a1 hat, a2 hat, b1 hat are not particularly limited, while the output signal VO2/OUT of the $O_2$ sensor 4 is being stably controlled at the target value VO2/TARGET, there are developed a situation in which the demand differential air-fuel ratio usl determined by the sliding mode controller 13 and the target air-fuel ratio KCMD change smoothly with time, and a situation in which the demand differential air-fuel ratio usl and the target air-fuel ratio KCMD oscillate with time at a high frequency. Neither of these situations poses problems in controlling the output VO2/OUT of the $O_2$ sensor 4 at the target value VO2/TARGET. However, the situation in which the target air-fuel ratio KCMD oscillates with time at a high frequency is not preferable in smoothly operating the internal combustion engine 1.

A study of the above phenomenon by the inventors has shown that whether the demand differential air-fuel ratio usl and the target air-fuel ratio KCMD change smoothly or oscillate at a high frequency is affected by the combinations of the values of the identified gain coefficients a1 hat, a2 hat identified by the identifier 11 and the value of the identified gain coefficient b1 hat.

In the present embodiment, the first and second limiting conditions are established appropriately, and the combinations of the values of the identified gain coefficients a1 hat, a2 hat and the value of the identified gain coefficient b1 hat are appropriately limited to eliminate the situation in which the target air-fuel ratio KCMD oscillates at a high frequency.

According to the present embodiment, the first and second limiting conditions are established as follows:

With respect to the first limiting condition for limiting the values of the identified gain coefficients a1 hat, a2 hat, the study by the inventors indicates that obtaining the demand differential air-fuel ratio usl and the target air-fuel ratio KCMD is closely related to combinations of the coefficient values α1, α2 in the equation (10) which are determined by the values of the gain coefficients a1, a2, i.e., the coefficient values α1, α2 used for the estimator 26 to determine the estimated differential output VO2(k+d) bar (the coefficient values α1, α2 are the first-row, first-column element and the first-row, second-column element of the matrix $A^d$ which is a power of the matrix A defined by the equation (10)).

Specifically, as shown in FIG. 9, when a coordinate plane whose coordinate components are represented by the coefficient values α1, α2 is established, if a point on the coordinate plane which is determined by a combination of the coefficient values α1, α2 lies in a hatched range, which is surrounded by a triangle $Q_1Q_2Q_3$ (including the boundaries) and will hereinafter be referred to as an "estimating coefficient stable range", then the target differential air-fuel ratio kcmd and the target air-fuel ratio KCMD tend to be smooth.

Therefore, the combinations of the values of the gain coefficients a1, a2 identified by the identifier 11, i.e., the combinations of the values of the identified gain coefficients a1 hat, a2 hat, should be limited such that the point on the coordinate plane shown in FIG. 9 which corresponds to the combination of the coefficient values α1, α2 determined by the values of the gain coefficients a1, a2 or the values of the identified gain coefficients a1 hat, a2 hat will lie within the estimating coefficient stable range.

In FIG. 9, a triangular range $Q_1Q_4Q_3$ on the coordinate plane which contains the estimating coefficient stable range is a range that determines combinations of the coefficient values α1, α2 which makes theoretically stable a system defined according to the following equation (25), i.e., a system defined by an equation similar to the equation (10) except that VO2(k), VO2(k−1) on the right side of the equation (12) are replaced respectively with VO2(k) bar, VO2(k−1) bar (VO2(k) bar, VO2(k−1) bar mean respectively an estimated differential output determined in each control cycle by the estimator 12 and an estimated differential output determined in a preceding cycle by the estimator 12).

$$\overline{VO2}(k+d) = \alpha 1 \cdot \overline{VO2}(k) + \alpha 2 \cdot \overline{VO2}(k-1) + \sum_{j=1}^{d} \beta_j \cdot kcmd(k-j) \tag{25}$$

The condition for the system defined according to the equation (25) to be stable is that a pole of the system (which is given by the following equation (26)) exists in a unit circle on a complex plane:

Pole of the system according to the equation (25)

$$= \frac{\alpha 1 \pm \sqrt{\alpha 1^2 + 4 \cdot \alpha 2}}{2} \tag{26}$$

The triangular range $Q_1Q_4Q_3$ shown in FIG. 9 is a range for determining the combinations of the coefficient values α1, α2 which satisfy the above condition. Therefore, the estimating coefficient stable range is a range indicative of those combinations where $\alpha 1 \geqq 0$ of the combinations of the coefficient values α1, α2 which make stable the system defined by the equation (25).

Since the coefficient values α1, α2 are determined by a combination of the values of the gain coefficients a1, a2, a combination of the values of the gain coefficients a1, a2 is determined by a combination of the coefficient values α1, α2. Therefore, the estimating coefficient stable range shown in FIG. 9 which determines preferable combinations of the coefficient values $\alpha 1$, $\alpha 2$ can be converted into a range on a coordinate plane shown in FIG. 10 whose coordinate components are represented by the gain coefficients a1, a2. Specifically, the estimating coefficient stable range shown in FIG. 9 is converted into a range enclosed by the imaginary lines in FIG. 10, which is a substantially triangular range having an undulating lower side and will hereinafter be referred to as an "identifying coefficient stable range", on the coordinate plane shown in FIG. 10. Stated otherwise, when a point on the coordinate plane shown in FIG. 10 which is determined by a combination of the values of the gain coefficients a1, a2 resides in the identifying coefficient stable range, a point on the coordinate plane shown in FIG. 9 which corresponds to the combination of the coefficient values $\alpha 1$, $\alpha 2$ determined by those values of the gain coefficients a1, a2 resides in the estimating coefficient stable range.

Figure 10:
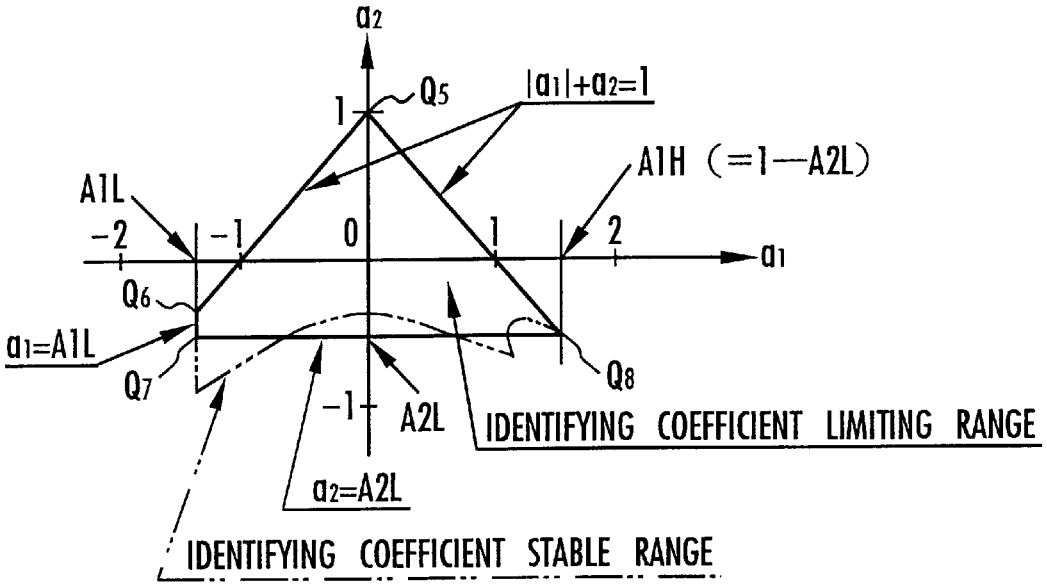
FIG. 10 is a diagram illustrative of partial processing of the flowchart shown in FIG. 8.

Consequently, the first limiting condition for limiting the values of the identified gain coefficients a1 hat, a2 hat determined by the identifier 11 should preferably be basically established such that a point on the coordinate plane shown in FIG. 10 which is determined by those values of the identified gain coefficients a1 hat, a2 hat reside in the identifying coefficient stable range.

However, since a boundary (lower side) of the identifying coefficient stable range indicated by the imaginary lines in FIG. 10 is of a complex undulating shape, a practical process for limiting the point on the coordinate plane shown in FIG. 10 which is determined by the values of the identified gain coefficients a1 hat, a2 hat is liable to be complex.

For this reason, according to the present embodiment, the identifying coefficient stable range is substantially approximated by a quadrangular range $Q_5Q_6Q_7Q_8$ enclosed by the solid lines in FIG. 10, which has straight boundaries and will hereinafter be referred to as an "identifying coefficient limiting range". As shown in FIG. 10, the identifying coefficient limiting range is a range enclosed by a polygonal line (including line segments $Q_5Q_6$ and $Q_5Q_8$) expressed by a functional expression $|a1|+a2=1$, a straight line (including a line segment $Q_6Q_7$) expressed by a constant-valued functional expression a1=A1L (A1L: constant), and a straight line (including a line segment $Q_7Q_8$) expressed by a constant-valued functional expression a2=A2L (A2L: constant). The first limiting condition for limiting the values of the identified gain coefficients a1 hat, a2 hat is established such that the point on the coordinate plane shown in FIG. 10 which is determined by those values of the identified gain coefficients a1 hat, a2 hat lies in the identifying coefficient limiting range. Although part of the lower side of the identifying coefficient limiting range deviates from the identifying coefficient stable range, it has experimentally been confirmed that the point determined by the identified gain coefficients a1 hat, a2 hat determined by the identifier 11 does not actually fall in the deviating range. Therefore, the deviating range will not pose any practical problem.

The above identifying coefficient limiting range is given for illustrative purpose only, and may be equal to or may substantially approximate the identifying coefficient stable range, or may be of any shape insofar as most or all of the identifying coefficient limiting range belongs to the identifying coefficient stable range. Thus, the identifying coefficient limiting range may be established in various configurations in view of the ease with which to limit the values of the identified gain coefficients a1 hat, a2 hat and the practical controllability. For example, while the boundary of an upper portion of the identifying coefficient limiting range is defined by the functional expression $|a1|+a2=1$ in the illustrated embodiment, combinations of the values of the gain coefficients a1, a2 which satisfy this functional expression are combinations of theoretical stable limits where a pole of the system defined by the equation (26) exists on a unit circle on a complex plane. Therefore, the boundary of the upper portion of the identifying coefficient limiting range may be determined by a functional expression $|a1|+a2=r$ (r is a value slightly smaller than "1" corresponding to the stable limits, e.g., 0.99) for higher control stability.

The above identifying coefficient stable range shown in FIG. 10 as a basis for the identifying coefficient limiting range is given for illustrative purpose only. The identifying coefficient stable range which corresponds to the estimating coefficient stable range shown in FIG. 9 is affected by the dead time d (more precisely, its set value) and has its shape varied depending on the dead time d, as can be seen from the definition of the coefficient values $\alpha 1$, $\alpha 2$ (see the equation (10)). Irrespective of the shape of the identifying coefficient stable range, the identifying coefficient limiting range may be established, as described above, in a manner to match the shape of the identifying coefficient stable range.

In the present embodiment, the second limiting condition for limiting the value of the gain coefficient b1 identified by the identifier 11, i.e., the value of the identified gain coefficient b1 hat, is established as follows:

The inventors have found that the situation in which the time-depending change of the target air-fuel ratio KCMD is oscillatory at a high frequency tends to happen also when the value of the identified gain coefficient b1 hat is excessively large or small. According to the present embodiment, an upper limit value B1H and a lower limit value B1L (B1H>B1L>0) for the identified gain coefficient b1 hat are determined in advance through experimentation or simulation. Then, the second limiting condition is established such that the identified gain coefficient b1 hat is equal to or smaller than the upper limit value B1H and equal to or greater than the lower limit value B1L ($B1L \leqq b1\ hat \leqq B1H$).

Figure 11:
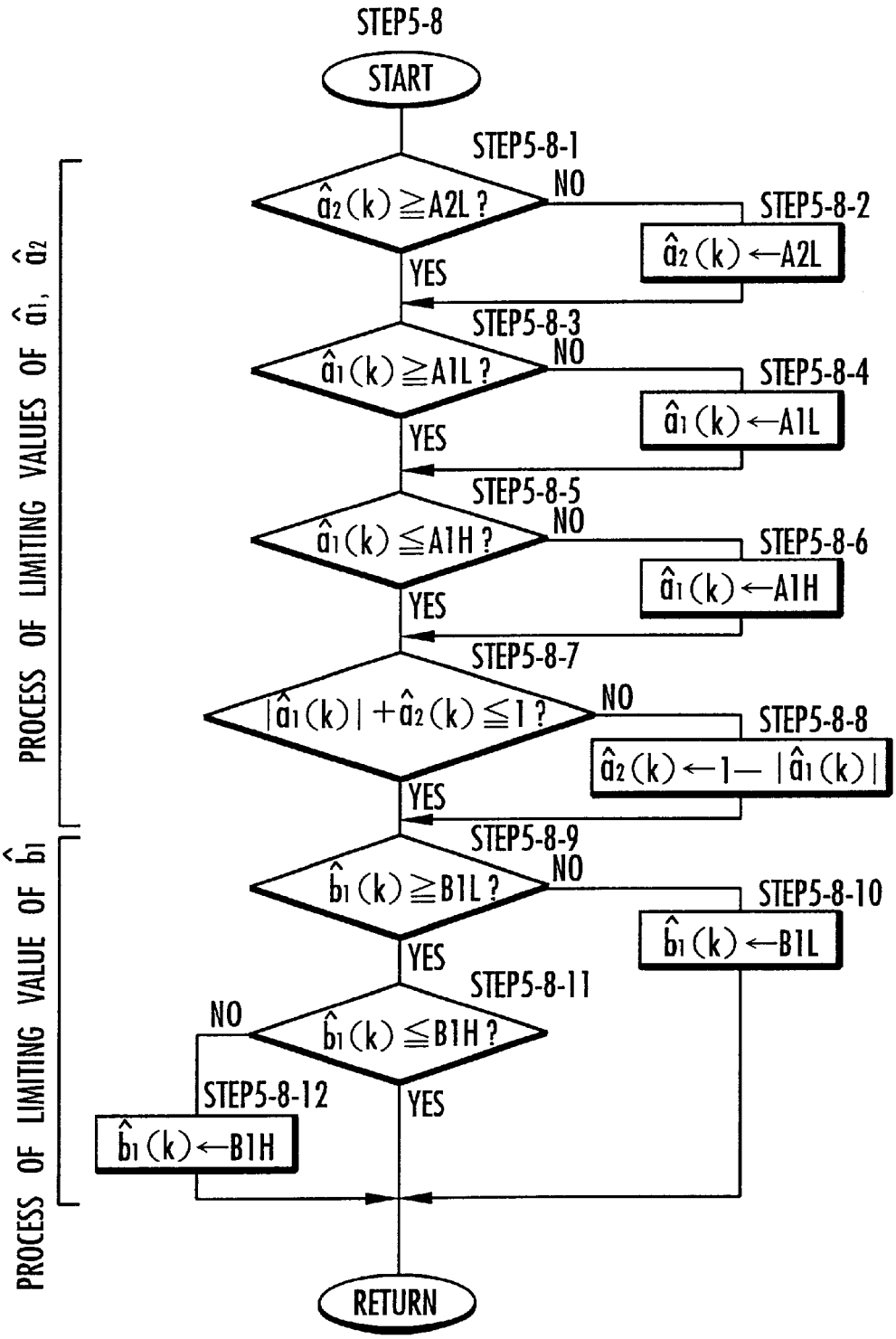
FIG. 11 is a flowchart of a subroutine of the flowchart shown in FIG. 8.

A process of limiting the values of the identified gain coefficients a1 hat, a2 hat, b1 hat according to the first and second limiting conditions is carried out by in STEP5-8 as follows:

As shown in FIG. 11, the identifier 11 limits combinations of the identified gain coefficients a1(k) hat, a2(k) hat determined in STEP5-7 shown in FIG. 10 according to the first limiting condition in STEP5-8-1 through STEP5-8-8.

Specifically, the identifier 11 decides whether or not the value of the identified gain coefficient a2(k) hat determined in STEP5-7 is equal to or greater than a lower limit value A2L (see FIG. 10) for the gain coefficient a2 in the identifying coefficient limiting range in STEP5-8-1.

If the value of the identified gain coefficient a2(k) is smaller than A2L, then since a point on the coordinate plane shown in FIG. 10, which is expressed by (a1(k) hat, a2(k) hat), determined by the combination of the values of the identified gain coefficients a1(k) hat, a2(k) hat does not reside in the identifying coefficient limiting range, the value of a2(k) hat is forcibly changed to the lower limit value A2L in STEP5-8-2. Thus, the point (a1(k) hat, a2(k) hat) on the coordinate plane shown in FIG. 10 is limited to a point in a region on and above a straight line, i.e., the straight line including the line segment $Q_7Q_8$, expressed by at least a2=A2L.

Then, the identifier 11 decides whether or not the value of the identified gain coefficient a1(k) hat determined in STEP5-7 is equal to or greater than a lower limit value A1L (see FIG. 10) for the gain coefficient a1 in the identifying coefficient limiting range in STEP5-8-3, and then decides whether or not the value of the identified gain coefficient a1(k) hat is equal to or smaller than an upper limit value A1H (see FIG. 10) for the gain coefficient a1 in the identifying coefficient limiting range in STEP5-8-5. The upper limit value A1H for the gain coefficient a1 in the identifying coefficient limiting range is represented by A1H=1−A2L because it is an a1 coordinate of the point $Q_8$ where the polygonal line |a1|+a2=1 (a1>0) and the straight line a2=A2L intersect with each other, as shown in FIG. 10.

If the value of the identified gain coefficient a1(k) hat is smaller than the lower limit value A1L or greater than the upper limit value A1H, then since the point (a1(k) hat, a2(k) hat) on the coordinate plane shown in FIG. 10 does not reside in the identifying coefficient limiting range, the value of a1(k) hat is forcibly changed to the lower limit value A1L or the upper limit value A1H in STEP5-8-4, STEP5-8-6.

Thus, the point (a1(k) hat, a2(k) hat) on the coordinate plane shown in FIG. 10 is limited to a region on and between a straight line, i.e., the straight line including the line segment $Q_6Q_7$, expressed by a1=A1L, and a straight line, i.e., the straight line passing through the point $Q_8$ and perpendicular to the a1 axis, expressed by a1=A1H.

The processing in STEP5-8-3 and STEP5-8-4 and the processing in STEP5-8-5 and STEP5-8-6 may be switched around. The processing in STEP5-8-1 and STEP5-8-2 may be carried out after the processing in STEP5-8-3 through STEP5-8-6.

Then, the identifier 11 decides whether the present values of a1(k) hat, a2(k) hat after STEP5-8-1 through STEP5-8-6 satisfy an inequality |a1|+a2≦1 or not, i.e., whether the point (a1(k) hat, a2(k) hat) is positioned on or below or on or above the polygonal line (including line segments $Q_5Q_6$ and $Q_5Q_8$) expressed by the functional expression |a1|+a2=1 in STEP5-8-7.

If |a1|+a2≦1, then the point (a1(k) hat, a2(k) hat) determined by the values of a1(k) hat, a2(k) hat after STEP5-8-1 through STEP5-8-6 exists in the identifying coefficient limiting range (including its boundaries).

If |a1|+a2>1, then since the point (a1(k) hat, a2(k) hat) deviates upwardly from the identifying coefficient limiting range, the value of the a2(k) hat is forcibly changed to a value (1−|a1(k) hat|) depending on the value of a1(k) hat in STEP5-8-8. Stated otherwise, while the value of a1(k) hat is being kept unchanged, the point (a1(k) hat, a2(k) hat) is moved onto a polygonal line expressed by the functional expression |a1|+a2=1, i.e., onto the line segment $Q_5Q_6$ or the line segment $Q_5Q_8$ which is a boundary of the identifying coefficient limiting range.

Through the above processing in STEP5-8-1 through 5-8-8, the values of the identified gain coefficients a1(k) hat, a2(k) hat are limited such that the point (a1(k) hat, a2(k) hat) determined thereby resides in the identifying coefficient limiting range. If the point (a1(k) hat, a2(k) hat) corresponding to the values of the identified gain coefficients a1(k) hat, a2(k) hat that have been determined in STEP5-7 exists in the identifying coefficient limiting range, then those values of the identified gain coefficients a1(k) hat, a2(k) hat are maintained.

The value of the identified gain coefficient a1(k) hat relative to the primary autoregressive term of the discrete-system model is not forcibly changed insofar as the value resides between the lower limit value A1L and the upper limit value A1H of the identifying coefficient limiting range. If a1(k) hat<A1L or a1(k) hat>A1H, then since the value of the identified gain coefficient a1(k) hat is forcibly changed to the lower limit value A1L which is a minimum value that the gain coefficient a1 can take in the identifying coefficient limiting range or the upper limit value A1H which is a maximum value that the gain coefficient a1 can take in the identifying coefficient limiting range, the change in the value of the identified gain coefficient a1(k) hat is minimum. Stated otherwise, if the point (a1(k) hat, a2(k) hat) corresponding to the values of the identified gain coefficients a1(k) hat, a2(k) hat that have been determined in STEP5-7 deviates from the identifying coefficient limiting range, then the forced change in the value of the identified gain coefficient a1(k) hat is held to a minimum.

After having limited the values of the identified gain coefficients a1(k) hat, a2(k) hat, the identifier 11 limits the identified gain coefficient b1(k) hat according to the second limiting condition in STEP5-8-9 through STEP5-8-12.

Specifically, the identifier 11 decides whether or not the value of the identified gain coefficient b1(k) hat determined in STEP5-7 is equal to or greater than the lower limit value B1L in STEP5-8-9. If the lower limit value B1L is greater than the value of the identified gain coefficient b1(k) hat, the value of b1(k) hat is forcibly changed to the lower limit value B1L in STEP5-8-10.

The identifier 11 decides whether or not the value of the identified gain coefficient b1(k) hat is equal to or smaller than the upper limit value B1H in STEP5-8-11. If the upper limit value B1H is smaller than the value of the identified gain coefficient b1(k) hat, the value of b1(k) hat is forcibly changed to the upper limit value B1H in STEP5-8-12.

If B1L≦b1(k) hat≦B1H, then the value of the identified gain coefficient b1(k) is maintained as it is.

Through the above processing in STEP5-8-9 through 5-8-12, the value of the identified gain coefficient b1(k) hat is limited to a range between the lower limit value B1L and the upper limit value B1H.

After the identifier 11 has limited the combination of the values of the identified gain coefficients a1(k) hat, a2(k) hat and the identified gain coefficient b1(k) hat, control returns to the sequence shown in FIG. 8.

The preceding values a1(k−1) hat, a2(k−1) hat, b1(k−1) hat of the identified gain coefficients used for determining the identified gain coefficients a1(k) hat, a2(k) hat, b1(k) hat in STEP5-7 shown in FIG. 8 are the values of the identified gain coefficients limited according to the first and second limiting conditions in STEP5-8 in the preceding control cycle.

After having limited the identified gain coefficients a1(k) hat, a2(k) hat, b1(k) hat as described above, the identifier 11 updates the matrix P(k) according to the equation (9) for the processing of a next control cycle in STEP5-9, after which control returns to the main routine shown in FIG. 6.

The processing subroutine of STEP5 for the identifier 11 has been described above.

In FIG. 6, after the processing of the identifier 11 has been carried out, the air-fuel ratio processing controller 5*a* determines the gain coefficients a1, a2, b1 in STEP6.

In STEP6, if the value of the flag f/id/cal set in STEP2 is "1", i.e., if the gain coefficients a1, a2, b1 have been identified by the identifier 11, then the values of the gain coefficients a1, a2, b1 are set to the identified gain coefficients a1 hat, a2 hat, b1 hat (limited in STEP5-8) determined by the identifier 11 in STEP5. If the value of the flag f/id/cal is "0", i.e., if the gain coefficients a1, a2, b1 have not been identified by the identifier 11, then the values of the gain coefficients a1, a2, b1 are set to predetermined values. The predetermined values to which the values of the gain coefficients a1, a2, b1 are set if f/id/cal=0, i.e., if the throttle valve of the internal combustion engine 1 is fully open or the fuel supplied to the internal combustion engine 1 is being cut off, are predetermined fixed values. If the situation where f/id/cal=0 is temporary, i.e., if the identifying process carried out by the identifier 11 is temporarily interrupted, then the values of the gain coefficients a1, a2, b1 may be held to the identified gain coefficients a1 hat, a2 hat, b1 hat determined by the identifier 11 immediately before f/id/cal=0.

Then, the air-fuel ratio processing controller 5*a* effects a processing operation of the estimator 12, i.e., a process of calculating the estimated differential output VO2 bar, in STEP7 of the main routine shown in FIG. 6.

The estimator 12 calculates the coefficients $\alpha 1$, $\alpha 2$, $\beta j$ (j=1−d) to be used in the equation (10), using the gain coefficients a1, a2, b1 determined in STEP6 (these values are basically the identified gain coefficients a1 hat, a2 hat, b1 hat which have been limited in STEP5-8 shown in FIG. 8).

Then, the estimator 12 calculates the estimated differential output VO2(k+d) bar (estimated value of the differential output VO2 after the dead time d from the time of the present control cycle) according to the equation (10), using the time-series data VO2(k), VO2(k−1), from before the present control cycle, of the differential output VO2 of the $O_2$ sensor calculated in each control cycle in STEP3 shown in FIG. 6, the time-series data kcmd(k−j) (j=1−d), from before the preceding control cycle (past), of the target differential air-fuel ratio kcmd, and the coefficients $\alpha 1$, $\alpha 2$, $\beta j$ (j=1−d) calculated as described above.

After the estimator 12 has determined the estimated differential output VO2(k+d) bar of the $O_2$ sensor 4, the air-fuel ratio processing controller 5*a* calculates the demand differential air-fuel ratio usl with the sliding mode controller 13 in STEP8.

Figure 12:
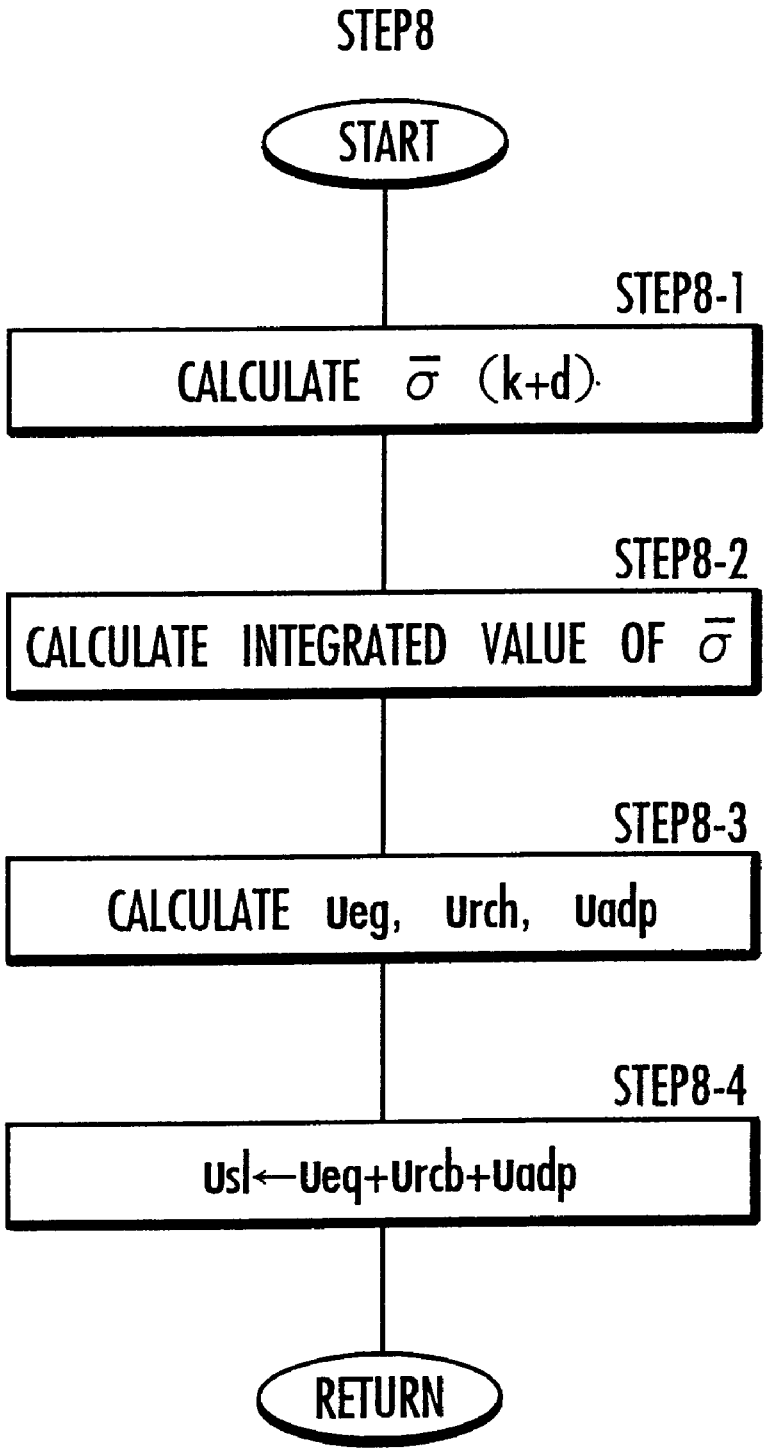
FIG. 12 is a flowchart of a subroutine of the flowchart shown in FIG. 6.

The calculating subroutine of STEP8 is shown in detail in FIG. 12.

As shown in FIG. 12, the sliding mode controller 13 calculates a value $\sigma$(k+d) bar (corresponding to an estimated value, after the dead time d, of the switching function $\sigma$ defined according to the equation (11)), after the dead time d from the present control cycle, of the switching function $\sigma$ bar defined according to the equation (21), using the time-series data VO2(k+d) bar, VO2(k+d−1) bar of the estimated differential output VO2 bar determined by the estimator 12 in STEP7 in STEP8-1.

If the switching function $\sigma$ bar is excessively large, then the value of the reaching control law input urch determined depending on the value of the switching function $\sigma$ bar becomes excessively large, causing the adaptive control law input uadp to change abruptly. Therefore, the demand differential air-fuel ratio usl tends to become inappropriate for converging the output VO2/OUT of the $O_2$ sensor 4 to the target value VO2/TARGET. According to the present embodiment, the value of the switching function $\sigma$ bar is set to fall in a predetermined range, and if the value of the $\sigma$ bar determined according to the equation (21) exceeds an upper or lower limit of the predetermined range, then the value of the $\sigma$ bar is forcibly set to the upper or lower limit of the predetermined range.

Then, the sliding mode controller 13 accumulates values of the switching function $\sigma$ bar calculated in respective control cycles in STEP8-1 (more accurately, values produced when the value of the $\sigma$ bar is multiplied by the period (constant period) of the control cycles of the air-fuel ratio processing controller 5*a*), i.e., adds a value of the $\sigma$ bar calculated in the present control cycle to the sum determined in the preceding control cycle, thereby calculating an integrated value of the $\sigma$ bar (which corresponds to the term at the right end of the equation (23)) in STEP8-2.

In order to prevent the adaptive control law input uadp determined depending on the integrated value of the $\sigma$ bar from becoming excessively large, the integrated value of the $\sigma$ bar is set to fall in a predetermined range, as with STEP8-1. Specifically, if the integrated value of the $\sigma$(k+d) bar exceeds an upper or lower limit of the predetermined range, then the integrated value of the $\sigma$(k+d) bar is forcibly limited to the upper or lower limit.

The integrated value of the $\sigma$ bar is held to the present value if the flag f/prism/on set in STEPd shown in FIG. 4 is "0", i.e., the target air-fuel ratio KCMD generated by the air-fuel ratio processing controller 5*a* is not used by the fuel processing controller 5*b*.

Then, the sliding mode controller 13 calculates the equivalent control law input ueq, the reaching control law input urch, and the adaptive control law uadp according to the respective equations (20), (22), (23) in STEP8-3, using the time-series data VO2 (k+d) bar, VO2(k+d−1) bar of the estimated differential output VO2 bar determined by the estimator 12 in STEP7, the value $\sigma$(k+d) bar of the switching function and its integrated value which are determined respectively in STEP8-1 and STEP8-2, and the gain coefficients a1, a2, b1 determined in STEP 6 (which are basically the gain coefficients a1 hat, a2 hat, b1 hat limited in STEP5-8 shown in FIG. 8).

The sliding mode controller 13 then adds the equivalent control law input ueq, the reaching control law input urch, and the adaptive controller law uadp determined in STEP8-3 to calculate an input quantity to be applied to the object system E for converging the demand differential air-fuel ratio usl, i.e., the output signal VO2/OUT of the $O_2$ sensor 4 to the target value VO2/TARGET in STEP8-4.

The processing operation of the sliding mode controller 13 in STEP8 has been described above.

In FIG. 6, the air-fuel ratio processing controller 5*a* carries out a process of determining the stability of the adaptive sliding mode control process performed by the sliding mode controller 13, more specifically, the stability of the controlled status of the output signal VO2/OUT of the $O_2$ sensor 4 based on the adaptive sliding mode control process (hereinafter referred to as an "SLD control status"), and sets a value of a flag f/sld/stb indicative of whether the SLD control status is stable or not, in STEP9.

Figure 13:
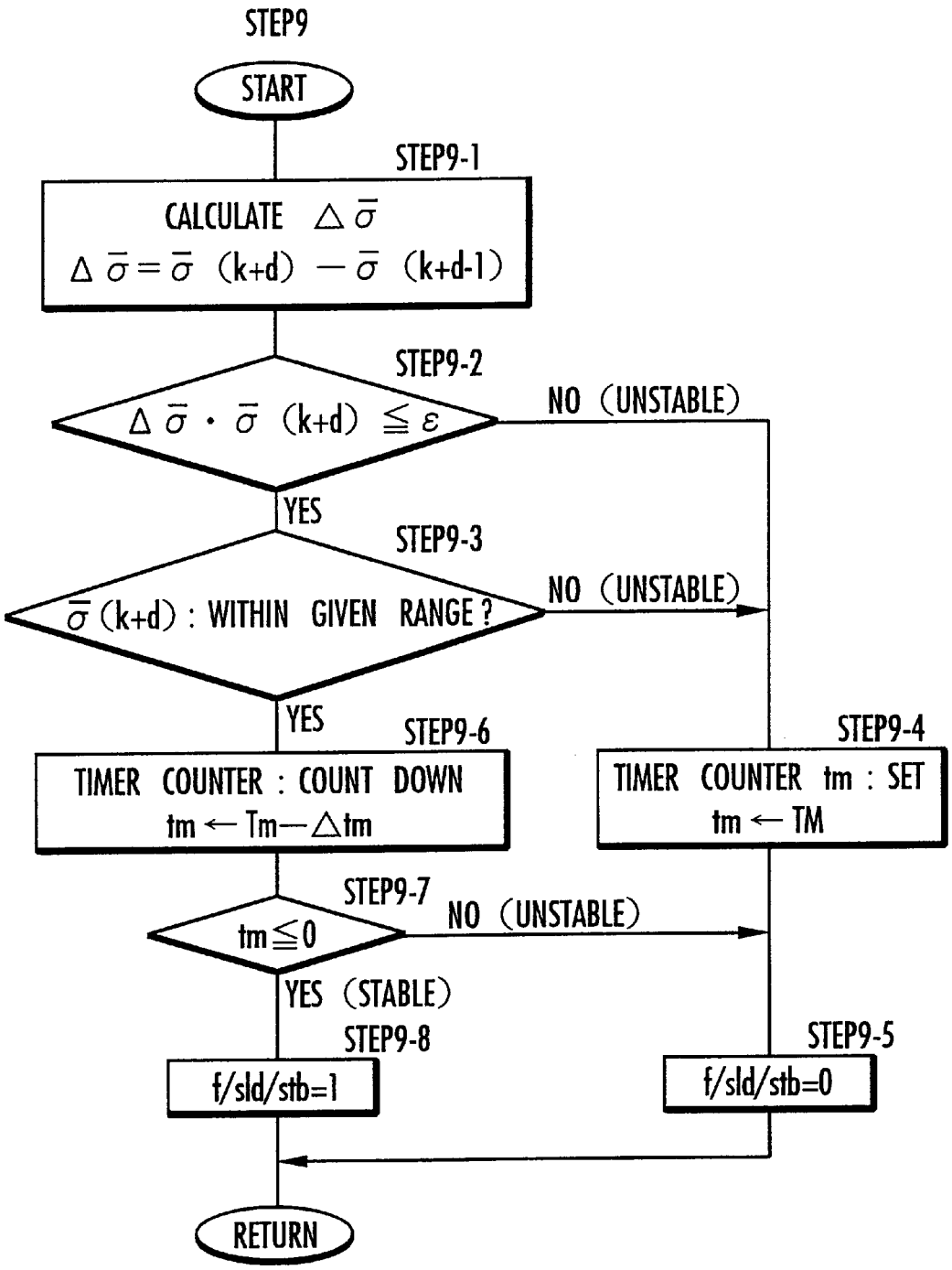
FIG. 13 is a flowchart of a subroutine of the flowchart shown in FIG. 6.

The determining subroutine of STEP9 is shown in detail in FIG. 13.

As shown in FIG. 13, the air-fuel ratio processing controller 5*a* calculates a difference $\Delta\sigma$ bar (corresponding to a rate of change of the switching function $\sigma$ bar) between the present value $\sigma$(k+d) bar of the switching function $\sigma$ calculated in STEP8-1 and a preceding value $\sigma$(k+d−1) bar of the switching function $\sigma$ bar in STEP9-1.

Then, the air-fuel ratio processing controller 5*a* decides whether or not a product $\Delta\sigma$ bar·$\sigma$(k+d) bar (corresponding to the time-differentiated function of a Lyapunov function $\sigma$ bar$^2$/2 relative to the $\sigma$ bar) of the difference $\Delta\sigma$ bar and the present value $\sigma$(k+d) bar of the switching function $\sigma$ bar is equal to or smaller than a predetermined value $\epsilon$ (>0) in STEP9-2.

The product $\Delta\sigma$ bar·$\sigma$(k+d) bar (hereinafter referred to as a "stability determining parameter Pstb") will be described below. The state in which the value of the stability determining parameter Pstb is Pstb>0 is basically a state in which the state quantity X comprising the estimated differential outputs VO2(k+d), VO2(k+d−1) is getting away from the hyperplane $\sigma$=0, i.e., a state in which the value of the switching function $\sigma$ bar=0 is getting away from "0". The state in which the value of the stability determining parameter Pstb is Pstb$\leqq$0 is basically a state in which the state quantity X is converged to or converging to the hyperplane $\sigma$=0, i.e., a state in which the value of the switching function $\sigma$ bar=0 is converged to or converging to "0". Generally, according to the sliding mode control process, in order to converge the controlled variable (the output VO2/OUT of the $O_2$ sensor 4 in this embodiment0 stably to the target value, the value of the switching function needs to be converged stably to "0". Basically, therefore, it is possible to determine whether the SLD control status is stable or not based on whether or not the value of the stability determining parameter Pstb is equal to or smaller than "0".

However, if the stability of the SLD control status is determined by comparing the value of the stability determining parameter Pstb with "0", then any slight noise contained in the value of the switching function $\sigma$ bar will affect the determined result of the stability.

In this embodiment, the predetermined value $\epsilon$ to be compared with the stability determining parameter Pstb=$\Delta\sigma$ bar·$\sigma$(k+d) bar is of a positive value slightly greater than "0".

If Pstb>$\epsilon$ ($\Delta\sigma$ bar·$\sigma$(k+d) bar>$\epsilon$) in STEP9-2, then the SLD control status is judged as being unstable, and the value of a timer counter tm (count-down timer) is set to a predetermined initial value TM (the timer counter tm is started) in order to inhibit the determination of the target air-fuel ratio KCMD using the demand differential air-fuel ratio usl (=ueq+urch+uadp) calculated in STEP8, in STEP9-4. Thereafter, the value of the flag f/sld/stb is set to "0" (the flag f/sld/stb=0 represents that the SLD processing status is unstable) in STEP9-5, after which control returns to the main routine shown in FIG. 6.

If Pstb≦$\epsilon$ ($\Delta\sigma$ bar·$\sigma$(k+d) bar≦$\epsilon$) in STEP9-2, then the air-fuel ratio processing controller 5*a* decides whether the present value $\sigma$(k+d) bar of the switching function $\sigma$ bar falls within a predetermined range or not in STEP9-3.

If the present value $\sigma$(k+d) bar of the switching function $\sigma$ bar does not fall within the predetermined range, then since the state quantity X comprising the estimated differential outputs VO2(K+d), VO2(k+d−1) is spaced widely apart from the hyperplane $\sigma$=0, and hence the demand differential air-fuel ratio usl is possibly inappropriate for converging the output VO2/OUT of the $O_2$ sensor 4 stably to the target value VO2/TARGET. Therefore, if the present value $\sigma$(k+d) bar of the switching function $\sigma$ bar does not fall within the predetermined range in STEP9-3, then the SLD control statue is judged as being unstable, and the processing of STEP9-4 through STEP9-5 is executed to start the timer counter tm and set the value of the flag f/sld/stb to "0".

In this embodiment, the decision process of STEP9-3 may be dispensed with because the value of the switching function $\sigma$ is limited in STEP8-1 carried out by the sliding mode controller 13.

If the present value $\sigma$(k+d) bar of the switching function $\sigma$ bar falls within the predetermined range in STEP9-3, then the air-fuel ratio processing controller 5*a* counts down the timer counter tm for a predetermined time $\Delta$tm in STEP9-6. The air-fuel ratio processing controller 5*a* then decides whether or not the value of the timer counter tm is equal to or smaller than "0", i.e., whether a time corresponding to the initial value TM has elapsed from the start of the timer counter tm or not, in STEP9-7.

If tm>0, i.e., if the timer counter tm is still measuring time and its set time has not yet elapsed, then since no substantial time has elapsed after the SLD control status has been judged as being unstable in STEP9-2 or STEP9-3, the SLD control status tends to become unstable. In this case (tm>0 in STEP9-7), therefore, the value of the flag f/sld/stb is set to "0" in STEP9-5.

If tm≦0 in STEP9-7, i.e., if the set time of the timer counter tm has elapsed, then the SLD control status is judged as being stable, and the value of the flag f/sld/stb is set to "1" (the flag f/sld/stb=1 represents that the SLD control status is stable) in STEP9-8.

The air-fuel ratio processing controller 5*a* determines the stability of the SLD control status as described above. If the SLD control status is judged as being unstable, then the value of the flag f/sld/stb is set to "0", and if the SLD control status is judged as being stable, then the value of the flag f/sld/stb is set to "1".

The above process of determining the stability of the SLD control status is illustrative only. Other processes may be used to determine the stability of the SLD control status. For example, in each given period longer than the control cycle, the frequency at which the value of the stability determining parameter Pstb is greater than the predetermined value $\epsilon$ may be measured. If the frequency exceeds a predetermined value, then the SLD control status may be judged as being unstable, and otherwise, the SLD control status may be judged as being stable.

Referring back to FIG. 6, after having set the value of the flag f/sld/stb indicative of the stability of the SLD control status, the air-fuel ratio processing controller 5*a* determines the value of the flag f/sld/stb in STEP 10. If f/sld/stb=1, i.e., if the SLD control status is judged as being stable, then the air-fuel ratio processing controller 5*a* limits the demand differential air-fuel ratio usl which is generated by the sliding mode controller 13 in the present control cycle in STEP11.

The above limiting process determines whether the demand differential air-fuel ratio usl is of a value within a predetermined allowable range or not. If the demand differential air-fuel ratio usl exceeds an upper or lower limit of the allowable range, then the value of the demand differential air-fuel ratio usl is forcibly set to the upper or lower limit of the allowable range. If the value of the demand differential air-fuel ratio usl falls in the allowable range (normal), then the demand differential air-fuel ratio usl is held to the present value, i.e., the value (=ueq+urch+uadp) generated by the sliding mode controller 13 in STEP8.

While the allowable range in the limiting process may be a predetermined fixed range, it may variably be established depending on operating conditions of the internal combustion engine 1 or how the demand differential air-fuel ratio usl deviates from the allowable range.

After having limited the demand differential air-fuel ratio usl to a value within the allowable range according to the above limiting process, the adder 14 in the air-fuel ratio processing controller 5*a* adds the air-fuel ratio reference value FLAF/BASE to the demand differential air-fuel ratio usl for thereby determining a target air-fuel ratio KCMD in the present control cycle in STEP12. In this manner, the process carried out by the air-fuel ratio processing controller 5*a* in the present control cycle is finished.

If f/sld/stb=0, i.e., if the SLD control status is judged as being unstable, in STEP10, then the air-fuel ratio processing controller 5*a* forcibly sets the demand differential air-fuel ratio usl in the present control cycle to a predetermined value (a fixed value or the previous value of the demand differential air-fuel ratio usl) in STEP 13. Thereafter, the adder 14 adds the air-fuel ratio reference value FLAF/BASE to the demand differential air-fuel ratio usl for thereby determining a target air-fuel ratio KCMD in STEP12, whereupon the process carried out by the air-fuel ratio processing controller 5*a* in the present control cycle is finished.

The target air-fuel ratio KCMD finally determined in STEP12 is stored in a time-series fashion in a non-illustrated memory in successive control cycles. For the fuel processing controller 5*b* to use the target air-fuel ratio KCMD determined by the air-fuel ratio processing controller 5*a,* the latest value of the target air-fuel ratio KCMD stored in the time-series fashion is selected.

Details of the operation of the air-fuel ratio control system according to the present embodiment have been described above.

The operation of the air-fuel ratio control system is summarized as follows: Basically, the air-fuel ratio processing controller 5*a* sequentially generates the target air-fuel ratio KCMD as an input quantity to be given to the object system E for converging the output signal VO2/OUT from the $O_2$ sensor 4 disposed downstream of the catalytic converter 3 to the target value VO2/TARGET. The air-fuel ratio processing controller 5*a* adjusts the fuel injection quantity of the internal combustion engine 1 according to the feed-forward control process depending on the target air-fuel ratio KCMD to manipulate the air-fuel ratio of the internal combustion engine 1 into the target air-fuel ratio KCMD. In this manner, the output signal VO2/OUT from the $O_2$ sensor 4 as an output quantity of the object system E is converged to the target air-fuel ratio KCMD, making the catalytic converter 3 capable of performing an optimum exhaust gas purifying capability regardless of aging thereof.

In the air-fuel ratio processing controller 5*a,* the sliding mode controller 13 performs the sliding mode control process which is highly stable against the effect of disturbances to generate the target air-fuel ratio KCMD for converging the output signal VO2/OUT from the $O_2$ sensor 4 to the target value VO2/TARGET. In this embodiment, the adaptive sliding mode control process which includes the adaptive control law (adaptive algorithm) for minimizing the effect of disturbances is employed. Therefore, the control process for converging the output signal VO2/OUT from the $O_2$ sensor 4 to the target value VO2/TARGET can stably be carried out while minimizing the effect of disturbances.

In generating the target air-fuel ratio KCMD according to the adaptive sliding mode control process, the object system E including the internal combustion engine 1 and the catalytic converter 3, i.e., a system for generating the output signal VO2/OUT of the $O_2$ sensor 4 from the target air-fuel ratio KCMD, is regarded in its entirety as a controlled object, and the behavior of the object system E is modeled as a discrete-time system. The gain coefficients a1, a2, b1 as parameters to be established of the model (object system model) are sequentially identified on a realtime basis by the identifier 11 for thereby minimizing a modeling error of the actual object system E of the object system model regardless of behavioral changes of components of the object system E, such as the internal combustion engine 1 and the catalytic converter 3.

In the adaptive sliding mode control process, the demand differential air-fuel ratio usl as an input quantity to be given to the object system E, and hence the target air-fuel ratio KCMD (=usl+FLAF/BASE) are determined using the values of the identified gain coefficients a1, a2, b1, i.e., the values of the identified gain coefficients a1 hat, a2 hat, b1 hat.

Therefore, the generated target air-fuel ratio KCMD is made dependent on the behavior, from time to time, of the internal combustion engine 1 and the catalytic converter 3, and hence the target air-fuel ratio KCMD appropriate for converging the output signal VO2/OUT from the $O_2$ sensor 4 to the target value VO2/TARGET can stably be generated irrespective of behavioral changes of components of the object system E, such as the internal combustion engine 1 and the catalytic converter 3. As a consequence, even though the air-fuel ratio of the internal combustion engine 1 is manipulated into the target air-fuel ratio KCMD according to the feed-forward control process, the control process for converging the output signal VO2/OUT from the $O_2$ sensor 4 to the target value VO2/TARGET can stably and accurately be performed in various operating states of the internal combustion engine 1 and various behavioral states of the catalytic converter 3. Since no sensor is required to detect the actual air-fuel ratio in order to manipulate the air-fuel ratio of the internal combustion engine 1 into the target air-fuel ratio KCMD, a system arrangement for converging the output signal VO2/OUT from the $O_2$ sensor 4 to the target value VO2/TARGET can be made simple and inexpensive.

In this embodiment, the object system model is constructed in view of the dead time d of the object system E, and the estimated differential output VO2 bar corresponding to the estimated value of the output VO2/OUT from the $O_2$ sensor 4 after the dead time d is sequentially determined by the estimator 12. At this time, because the estimated differential output VO2 is generated using the identified gain coefficients a1, a2, b1 as parameters of the object system model, identified by the identifier 11, the estimated differential output VO2 can be generated with high accuracy irrespective of behavioral changes of the internal combustion engine 1 and the catalytic converter 3. According to the adaptive sliding mode control process, the demand differential air-fuel ratio usl and hence the target air-fuel ratio KCMD are determined for converging the estimated differential output VO2 to "0", which is a target value for the differential output VO2 of the $O_2$ sensor 4, using the data of the estimated differential output VO2. In this manner, the effect of the dead time d of the object system E is suitably eliminated, and the stability and accuracy of the control process for converging the output signal VO2/OUT from the $O_2$ sensor 4 to the target value VO2/TARGET can be increased.

In this embodiment, for calculating the identified error id/e in order to identify the gain coefficients a1, a2, b1 of the object system model with the identifier 11, the frequency characteristics of the object system E are taken into account, and the differential output VO2 corresponding to an actual output quantity of the object system E and the identified differential output VO2 hat which is an output quantity of the object system model are filtered with the same low-pass characteristics. In this manner, the accuracy of the identified gain coefficients a1 hat, a2 hat, b1 hat can be increased as they better match the behavior of the object system E. Using the identified gain coefficients a1 hat, a2 hat, b1 hat, the estimator 12 generates the estimated differential output VO2, and the sliding mode controller 13 performs the adaptive sliding mode control process for thereby performing, stably with high accuracy, the control process for converging the output signal VO2/OUT from the $O_2$ sensor 4 to the target value VO2/TARGET.

In this embodiment, furthermore, the values of the identified gain coefficients a1 hat, a2 hat, b1 hat determined by the identifier 11 are limited so as to satisfy the first and second limiting conditions that are established as described above. The demand differential air-fuel ratio usl generated by the sliding mode controller 13 and hence the target air-fuel ratio KCMD are reliably prevented from oscillating at a high frequency, so that the target air-fuel ratio KCMD which varies smoothly and stably can be generated. As a result, the control process for converging the output signal from the $O_2$ sensor 4 to the target value VO2/TARGET can be performed well while allowing the internal combustion engine 1 to operate smoothly. That is, the catalytic converter 3 can perform an optimum exhaust gas purifying capability while allowing the internal combustion engine 1 to operate smoothly.

The values of the identified gain coefficients a1 hat, a2 hat relative to the response delay of the object system E are not individually limited, but limited to a correlated combination. It is thus possible to obtain optimum values of the identified gain coefficients a1 hat, a2 hat for converging the output signal VO2/OUT from the $O_2$ sensor 4 to the target value VO2/TARGET and generating the target air-fuel ratio KCMD that is smooth and stable.

With respect to limiting combinations of the values of the identified gain coefficients a1 hat, a2 hat, the combinations of the values of the identified gain coefficients a1 hat, a2 hat are limited so as to minimize a change in the value of the identified gain coefficient a1 hat relative to a low-order autoregressive term (primary autoregressive term) of the autoregressive terms of the right-hand side of the equation (1) representing the object system model, i.e., so as to minimize a change in the value of the identified gain coefficient a1 hat relative to a new output VO2/OUT or differential output VO2 of the $O_2$ sensor 4 in the object system model. Thus, the reliability of the demand differential air-fuel ratio usl generated using these identified gain coefficients a1 hat, a2 hat, and hence the target air-fuel ratio KCMD can be increased, and the control process for converging the output signal VO2/OUT from the $O_2$ sensor 4 to the target value VO2/TARGET can stably be carried out.

Since the identifying coefficient limiting range (see FIG. 10) for limiting combinations of the identified gain coefficients a1 hat, a2 hat has a linear boundary, the process of limiting the values of the identified gain coefficients a1 hat, a2 hat can easily be performed.

In this embodiment, the stability of the SLD control status is determined. If the SLD control status is judged as being unstable (if f/sld/stb=0 in STEP10 shown in FIG. 6), the value of the demand differential air-fuel ratio usl and hence the value of the target air-fuel ratio KCMD are forcibly set to a predetermined value. Therefore, in a situation where the SLD control status is judged as being unstable, changes in the air-fuel ratio of the internal combustion engine 1 manipulated depending on the target air-fuel ratio KCMD are limited. As a result, variations of the output VO2/OUT of the $O_2$ sensor 4 are suppressed, preventing a situation which would cause unstable behavioral changes of the output VO2/OUT and hence a situation which would impair the purifying capability of the catalytic converter 3.

The air-fuel ratio control system for the internal combustion engine according to the present invention is not limited to the above embodiment, but may be modified as follows:

In the above embodiments, the $O_2$ sensor 4 is employed as an exhaust gas sensor disposed downstream of the catalytic converter 3. However, the exhaust gas sensor may be any of various other types of sensors insofar as it can detect the concentration of a particular component of an exhaust gas downstream of the catalytic converter to be controlled. For example, if carbon monoxide (CO) in an exhaust gas downstream of the catalytic converter is to be controlled, the exhaust gas sensor may comprise a CO sensor. If nitrogen oxide (NOx) in an exhaust gas downstream of the catalytic converter is to be controlled, the exhaust gas sensor may comprise an NOx sensor. If hydrocarbon (HC) in an exhaust gas downstream of the catalytic converter is to be controlled, the exhaust gas sensor may comprise an HC sensor. When a three-way catalytic converter is employed, then even if the concentration of any of the above gas components is detected, it may be controlled to maximize the purifying performance of the three-way catalytic converter. If a catalytic converter for oxidation or reduction is employed, then purifying performance of the catalytic converter can be increased by directly detecting a gas component to be purified.

In the above embodiment, the object system model and the processing operation of the identifier 11, the estimator 12, and the sliding mode controller 13 employs the target differential air-fuel ratio kcmd as data representing the target air-fuel ratio KCMD given from the air-fuel processing controller 5*a* to the fuel processing controller 5*b* of the object system E, and the differential output VO2 as data representing the output VO2/OUT of the $O_2$ sensor 4 as an output quantity of the object system E. However, the model of the object system E may be constructed and the processing operation of the identifier 11, the estimator 12, and the sliding mode controller 13 may be carried out, directly using the target air-fuel ratio KCMD and the data of the output VO2/OUT of the $O_2$ sensor 4. However, for the purpose of simplifying the object system model and simplifying the processing operation of the identifier 11, the estimator 12, and the sliding mode controller 13, and increasing the reliability of the control of the output VO2/OUT of the $O_2$ sensor 4, it is preferable to employ the target air-fuel ratio KCMD and the data of the output VO2/OUT of the $O_2$ sensor 4, as with the above embodiment.

In the above embodiment, the air-fuel ratio reference value FLAF/BASE relative to the target differential air-fuel ratio kcmd is of a constant value. However, the air-fuel ratio reference value FLAF/BASE may variably be established as follows:

The object system model represented by the equation (1) is a model in which the target differential air-fuel ratio kcmd (=KCMD−FLAF/BASE) is "0" in a state where the output signal VO2/OUT from the $O_2$ sensor 4 is steadily converged to the target value VO2/TARGET, i.e., a state where the differential output VO2 is steadily converged to "0", hereinafter referred to as a "steadily converged state"). In the object system model, therefore, the air-fuel ratio reference value FLAF/BASE should be of a central value of the target air-fuel ratio KCMD in the steadily converged state. In a situation where the air-fuel ratio reference value FLAF/BASE suffers a relatively large error with respect to the actual central value of the target air-fuel ratio KCMD (such a situation arises when the actual air-fuel ratio of the internal combustion engine 1 has a steady error with respect to the target air-fuel ratio KCMD, for example), it is considerable preferable to adjust the air-fuel ratio reference value FLAF/BASE so as to be closer to the actual central value of the target air-fuel ratio KCMD.

As can be seen from the above equations (20)–(23), in the steadily converged state, usl=uadp because the equivalent control law input ueq and the reaching control law input urch of the components of the demand differential air-fuel ratio usl determined by the sliding mode controller 13 are "0". At this time, the target air-fuel ratio KCMD is basically equal to the sum of the adaptive control law input uadp which represents the demand differential air-fuel ratio usl and the air-fuel ratio reference value FLAF/BASE (=uadp+FLAF/BASE). Therefore, the adaptive control law input uadp corresponds to an error of the air-fuel ratio reference value FLAF/BASE with respect to the actual central value of the target air-fuel ratio KCMD in the steadily converged state, and performs a function to absorb such an error.

By adjusting the value of the air-fuel ratio reference value FLAF/BASE depending on the adaptive control law input uadp, i.e., variably setting the value of the air-fuel ratio reference value FLAF/BASE, so that the adaptive control law input uadp will be of a value close to "0", it is possible to bring the value of the air-fuel ratio reference value FLAF/BASE closely to the actual central value of the target air-fuel ratio KCMD in the steadily converged state. More specifically, if a process is carried out to gradually increase the air-fuel ratio reference value FLAF/BASE when the adaptive control law input uadp is greater than the value close to "0", and to gradually reduce the air-fuel ratio reference value FLAF/BASE when the adaptive control law input uadp is smaller than the value close to "0", then the above adjustment of the air-fuel ratio reference value FLAF/BASE can be carried out on a real-time basis.

With the air-fuel ratio reference value FLAF/BASE being thus adjusted depending on the adaptive control law input uadp determined by the sliding mode controller 13, i.e., with the air-fuel ratio reference value FLAF/BASE being variably established, it is possible to increase matching between the object system model expressed by the equation (1) and the actual object system E, i.e., to reduce the modeling error. It is thus possible to increase the reliability of the identified gain coefficients a1 hat, a2 hat, b1 hat determined by the identifier 11 and the estimated differential output VO2 bar of the $O_2$ sensor 4 determined by the estimator 12. As a consequence, the accuracy of the control process for converging the output signal VO2/OUT from the $O_2$ sensor 4 to the target value VO2/TARGET can be increased. Inasmuch as the absolute value of the adaptive control law input uadp determined by the sliding mode controller 13 may be small, the quick response of the control process for converging the output signal VO2/OUT from the $O_2$ sensor 4 to the target value VO2/TARGET can be increased.

In the above embodiment, the target air-fuel ratio KCMD is generated as a manipulated variable for manipulating the air-fuel ratio of the internal combustion engine 1 by the air-fuel ratio processing controller 5*a*. However, a corrective variable for the fuel injection quantity of the internal combustion engine 1 which corresponds to the second correction coefficient KCMDM may be generated as a manipulated variable for manipulating the air-fuel ratio of the internal combustion engine 1 so as to converge the output signal VO2/OUT from the $O_2$ sensor 4 to the target value VO2/TARGET.

In the above embodiment, the sliding mode controller 13 generates the demand differential air-fuel ratio usl according to the adaptive sliding mode control process. However, the demand differential air-fuel ratio usl and the target air-fuel ratio KCMD may be generated according to a general sliding mode control process which does not use the adaptive control law (adaptive algorithm). In such a case, the demand differential air-fuel ratio usl (=ueq+urch) may be determined according to the equation (3) where the adaptive control law input uadp is omitted, and the air-fuel ratio reference value FLAF/BASE may be added to the demand differential air-fuel ratio usl to generate the target air-fuel ratio KCMD.

Other control processes including an adaptive control process, an H∞control process, etc. than the sliding mode control process may be employed insofar as they can generate values corresponding to the demand differential air-fuel ratio usl and the target air-fuel ratio KCMD, using the identified gain coefficients a1 hat, a2 hat, b1 hat determined by the identifier 11.

In the above embodiment, the object system E is represented by the object system model including the primary autoregressive term and the secondary autoregressive term. However, the object system E may be represented by a model including autoregressive terms of higher orders. Similarly, the switching function for the adaptive sliding mode control process may be defined by a linear function (e.g., a linear function having VO2(k), VO2(k−1), VO2(k−2) as elements) having more time-series data of the differential output VO2 of the $O_2$ sensor 4.

In the above embodiment, when the SLD control status is judged as being unstable, the demand differential air-fuel ratio usl and the target air-fuel ratio KCMD are forcibly set to predetermined values. However, they may be limited to values in a sufficiently narrow given range. In this case, if the flag f/sld/stb is "0" (the SLD control status is judged as being unstable) in STEP10 in the main routine shown in FIG. 6, the demand differential air-fuel ratio usl may be limited by a dedicated allowable range (sufficiently narrow range) in the same manner as STEP11.

In the above embodiment, the estimator 12 is provided because the object system E has a relatively long dead time d. However, the estimator 12 may be dispensed with if the object system E has a sufficiently small dead time. In this case, the sliding mode controller may determine the equivalent control law input ueq, the reaching control law input urch, and the adaptive control law uadp according to the equations (14), (15), (18) where d=0, and then determine their sum as the demand differential air-fuel ratio usl. If the values of the parameters of the object system model which are identified by the identifier 11 are to be limited in this case as with the above embodiment, then the limiting conditions may be established through various experiments and simulations in view of the stability of control, etc., irrespective of the processing of the estimator 12. For example, combinations of the values of the identified gain coefficients a1 hat, a2 hat may be limited to the range $Q_1Q_2Q_3$ where $\alpha 1$, $\alpha 2$ in FIG. 9 are replaced with a1, a2, and the identified gain coefficient b1 hat may be limited so as to satisfy the condition BIL≦b1 hat≦BIH as with the above embodiment.

In the above embodiment, the dead time d of the object system E is fixed to a predetermined value. However, the dead time d as well as the gain coefficients a1, a2, b1 may be sequentially identified. In this case, the value of the dead time d that is identified may be limited according to suitable conditions in the same manner as with the gain coefficients a1, a2, b1.

Although a certain preferred embodiment of the present invention has been shown and described in detail, it should be understood that various changes and modifications may be made therein without departing from the scope of the appended claims.

What is claimed is:

1. An air-fuel ratio control system for an internal combustion engine, comprising:

an exhaust gas sensor for detecting the concentration of a component of an exhaust gas which has passed through a catalytic converter disposed in an exhaust passage of the internal combustion engine, said exhaust gas sensor being disposed downstream of said catalytic converter;

manipulated variable generating means for sequentially generating a manipulated variable for manipulating the air-fuel ratio of an air-fuel mixture to be combusted by the internal combustion engine in order to converge an output of said exhaust gas sensor to a predetermined target value;

air-fuel ratio manipulating means for manipulating the air-fuel ratio of the air-fuel mixture based on the manipulated variable generated by said manipulated variable generating means;

the arrangement being such that a system for generating the output of said exhaust gas sensor from said manipulated variable via said manipulated variable generating means, the internal combustion engine, and the catalytic converter is regarded as an object system, and the object system including an element relative to a response delay of the object system is expressed as a model by a discrete-time system; and identifying means for sequentially identifying a parameter to be established of the model using data of the manipulated variable generated by said manipulated variable generating means and data of the output of said exhaust gas sensor;

said manipulated variable generating means comprising means for generating said manipulated variable according to a feedback control process constructed based on said model using the parameter of the model identified by said identifying means and the data of the output of said exhaust gas sensor.

2. An air-fuel ratio control system according to claim 1, wherein said parameter of the model identified by said identifying means includes a gain coefficient of the element relative to said response delay.

3. An air-fuel ratio control system according to claim 1, wherein said model comprises a model in which the data of said manipulated variable is regarded as an input quantity given to said object system, the data of the output of said exhaust gas sensor is regarded as an output quantity generated by said object system, and said output quantity in each control cycle is represented by said output quantity and said input quantity in a past control cycle prior to said each control cycle.

4. An air-fuel ratio control system according to claim 3, wherein said input quantity comprises the difference between said manipulated variable and a predetermined reference value with respect to said manipulated variable, and said output quantity comprises the difference between output of said exhaust gas sensor and said target value.

5. An air-fuel ratio control system according to claim 3 or 4, wherein said parameter of the model identified by said identifying means comprises gain coefficients relative to said output quantity and said input quantity in said past control cycle of said model.

6. An air-fuel ratio control system according to claim 1, wherein said model includes an element relative to a dead time of said object system, further comprising estimating means for sequentially generating data representing an estimated value of the output of said exhaust gas sensor after said dead time according to an algorithm constructed based on said model, using the parameter of the model identified by said identifying means, the data of the manipulated variable generated by said manipulated variable generating means, and the data of the output of said exhaust gas sensor, said manipulated variable generating means comprising means for using the data, generated by said estimating means, representing the estimated value of the output of said exhaust gas sensor after said dead time, as the data of the output of said exhaust gas sensor to be used in said feedback control process.

7. An air-fuel ratio control system according to claim 6, wherein said parameter of the model identified by said identifying means includes a gain coefficient of the element relative to said response delay and a gain coefficient of the element relative to said dead time.

8. An air-fuel ratio control system according to claim 6, wherein said model comprises a model in which the data of said manipulated variable is regarded as an input quantity given to said object system, the data of the output of said exhaust gas sensor is regarded as an output quantity generated by said object system, and said output quantity in each control cycle is represented by said output quantity in a past control cycle prior to said each control cycle and said input quantity in a control cycle prior to said dead time.

9. An air-fuel ratio control system according to claim 8, wherein said input quantity comprises the difference between said manipulated variable and a predetermined reference value with respect to said manipulated variable, said output quantity comprises the difference between output of said exhaust gas sensor and said target value, and the data, generated by said estimating means, representing the estimated value of the output of said exhaust gas sensor after said dead time comprises the difference between the estimated value and said target value.

10. An air-fuel ratio control system according to claim 8 or 9, wherein said parameter of the model identified by said identifying means comprises gain coefficients relative to said output quantity in said past control cycle of said model and said input quantity in the control cycle prior to said dead time.

11. An air-fuel ratio control system according to claim 6, wherein said feedback control process performed by said manipulated variable generating means comprises a process for generating said manipulated variable in order to converge the estimated value of the output of said exhaust gas sensor after said dead time to said target value.

12. An air-fuel ratio control system according to claim 1 or 6, wherein said manipulated variable comprises a target air-fuel ratio for the air-fuel mixture, said air-fuel ratio manipulating means comprising means for manipulating the air-fuel ratio of the air-fuel mixture into said target air-fuel ratio depending on said target air-fuel ratio according to a feed-forward control process.

13. An air-fuel ratio control system according to claim 1, wherein said identifying means comprises means for limiting said parameter to be identified to a value which satisfies a predetermined condition.

14. An air-fuel ratio control system according to claim 6, wherein said identifying means comprises means for limiting said parameter to be identified to a value which satisfies a predetermined condition.

15. An air-fuel ratio control system according to claim 14, wherein said estimating means comprises means for generating the data representing the estimated value of the output of said exhaust gas sensor after said dead time according to predetermined calculations from the data of the manipulated variable generated by said manipulated variable generating means, the data of the output of said exhaust gas sensor, and a plurality of coefficients determined by the value of the parameter identified by said identifying means, and wherein said predetermined condition for limiting said parameter to be identified by said identifying means is established to set the plurality of coefficients determined by the value of the parameter to a predetermined combination.

16. An air-fuel ratio control system according to any one of claims 13 through 15, wherein said identifying means comprises means for identifying a plurality of parameters, said predetermined condition comprises a condition for limiting at least two of said parameters to a predetermined combination.

17. An air-fuel ratio control system according to any one of claims 13 through 15, wherein said predetermined condition comprises a condition for limiting upper and lower limits for at least one said parameter to be identified by said identifying means.

18. An air-fuel ratio control system according to any one of claims 13 through 15, wherein said identifying means comprises means for identifying said parameter according to an algorithm for updating and identifying the parameter using a value thereof in a past control cycle in each control cycle, the value of the parameter in the past control cycle being limited to a value which satisfies said predetermined condition.

19. An air-fuel ratio control system according to any one of claims 13 through 15, wherein said element relative to the response delay includes primary and secondary autoregressive terms relative to the output of said exhaust gas sensor, said parameter to be identified by said identifying means includes first and second gain coefficients relative to said primary and secondary autoregressive terms, respectively, and said predetermined condition is established such that a point in a coordinate plane which is determined by two coordinates represented by values of said first and second gain coefficients exists in a predetermined range in said coordinate plane.

20. An air-fuel ratio control system according to claim 19, wherein said predetermined range has a linear boundary.

21. An air-fuel ratio control system according to claim 19, wherein said predetermined range has a boundary including at least a portion which is defined by a predetermined function having said first and second gain coefficients as variables.

22. An air-fuel ratio control system according to claim 19, wherein said identifying means comprises means for, if the point in said coordinate plane which is determined by the values of said first and second gain coefficients identified based on the data of said manipulated variable and the data of the output of said exhaust gas sensor deviates from said predetermined range, changing the values of said first and second gain coefficients to values of points in said predetermined range so as to minimize a change in the value of said first gain coefficient for thereby limiting the values of said first and second gain coefficients.

23. An air-fuel ratio control system according to claim 1 or 6, wherein said identifying means comprises means for identifying said parameter according to an algorithm for identifying the parameter of said model in order to minimize an error between the output of said exhaust gas sensor in said model and an actual output of said exhaust gas sensor, further comprising means for filtering the output of said exhaust gas sensor in said model and the actual output of said exhaust gas sensor with the same frequency characteristics in calculating said error with said identifying means.

24. An air-fuel ratio control system according to claim 1, wherein said feedback control process performed by said manipulated variable generating means comprises a sliding mode control process.

25. An air-fuel ratio control system according to claim 6, wherein said feedback control process performed by said manipulated variable generating means comprises a sliding mode control process.

26. An air-fuel ratio control system according to claim 24 or 25, wherein said sliding mode control process comprises an adaptive sliding mode control process.

27. An air-fuel ratio control system according to claim 24 or 25, wherein said sliding mode control process employs a linear function having as elements a plurality of time-series data of the difference between the output of said exhaust gas sensor and said target value, as a switching function for the sliding mode control process.

28. An air-fuel ratio control system according to claim 24 or 25, further comprising means for determining the stability of a control process for converging the output of said exhaust gas sensor to said target value according to said sliding mode control process, said manipulated variable generating means comprising means for limiting said manipulated variable to be given to said air-fuel ratio manipulating means to a predetermined value or a value in a predetermined range when said control process is judged as being unstable.

29. An air-fuel ratio control system according to claim 28, wherein said means for determining the stability of the control process comprises means for determining the stability of the control process based on the value of switching function for the sliding mode control process.

* * * * *